US006006717A

United States Patent [19]

Suzuki et al.

[11] Patent Number: 6,006,717

[45] Date of Patent: Dec. 28, 1999

[54] DIRECT-INJECTION SPARK-IGNITION TYPE ENGINE CONTROL APPARATUS

[75] Inventors: Keisuke Suzuki, Kanagawa; Yuki Nakajima; Nobutaka Takahashi, both of Yokohama, all of Japan

[73] Assignee: Nissan Motor Co., Ltd., Yokohama, Japan

[21] Appl. No.: 09/104,359

[22] Filed: Jun. 25, 1998

[30] Foreign Application Priority Data

Jun. 25, 1997 [JP] Japan ..... 9-168419

[51] Int. Cl.[6] ..... F02B 17/00; F02D 43/04

[52] U.S. Cl. ..... 123/295; 123/406.45; 123/430

[58] Field of Search ..... 123/295, 299, 123/300, 305, 406.45, 430

[56] References Cited

U.S. PATENT DOCUMENTS 5,070,842 12/1991 Inoue et al. ..... 123/406.29
5,875,756 3/1999 Kamura et al. ..... 123/295
5,881,693 3/1999 Mizuno ..... 123/295
5,896,840 4/1999 Takahashi ..... 123/295

FOREIGN PATENT DOCUMENTS 59-37236 2/1984 Japan .
5-163996 6/1993 Japan .

OTHER PUBLICATIONS

Nissan Direct–Injection Engine, NEODi–Gasoline Engine Diesel Engine.

*Primary Examiner*—Tony M. Argenbright
*Attorney, Agent, or Firm*—Foley & Lardner

[57] ABSTRACT

The invention provides torque correction during both homogeneous combustion and stratified combustion. Torque correction is made in response to a torque correction demand (produced when, for example, a gear shift is effected, the air conditioner is turned on, or fuel cut recovery is effected) by correcting the spark timing (or the spark timing and air-fuel ratio) during homogeneous combustion and by correcting the air-fuel ratio during stratified combustion.

10 Claims, 25 Drawing Sheets

DIRECT-INJECTION SPARK-IGNITION TYPE ENGINE CONTROL APPARATUS

BACKGROUND OF THE INVENTION

This invention is directed to a direct-injection spark-ignition type engine control apparatus for correcting engine torque based on engine operating conditions.

It is conventional practice to realize a desired target torque (for example, during a gear shift operation made in an automatic transmission) using feedback control of the intake air flow rate in a manner to converge the engine torque to the target torque while correcting the spark timing according to a difference between the engine torque and the target torque. In order to achieve the target torque, the torque control (torque correction), which requires a faster response than intake air flow rate control can provide, is made by correcting spark timing, as discussed in Japanese Patent Kokai No. 5-163996.

In recent years, direct-injection spark-ignition type engines have attracted special interest. In such a direct-injection spark-ignition type engine, it is the current practice to make a combustion mode change, according to engine operating conditions, between homogeneous combustion (wherein fuel is injected during an intake stroke to diffuse the injected fuel so as to form a homogeneous mixture in the combustion chamber) and stratified combustion (wherein fuel is injected during a compression stroke to form a stratified fuel mixture around the spark plug) as discussed in Japanese Patent Kokai No. 59-37236.

With such a direct-injection spark-ignition type engine, sparks must be produced at a time when the mixture is close to the spark plug if torque correction is to be made by the use of spark timing during stratified combustion. However, the range over which spark timing can be corrected is too narrow to permit sufficient torque correction during stratified combustion. An attempt to correct spark timing to an excessive extent will cause degraded combustion performance and eventually misfire.

SUMMARY OF THE INVENTION

In view of these considerations, the invention has for an object providing a direct-injection spark-ignition type engine control apparatus which can ensure optimum torque correction when the combustion mode is either homogeneous combustion or stratified combustion.

The invention provides desired torque correction regardless of the combustion mode by controlling at least the spark timing to correct torque during homogeneous combustion and by controlling at least the air-fuel ratio to correct torque during stratified combustion. Torque correction is provided with a fast response to a torque correction demand that cannot be followed by intake air flow rate control, regardless of the combustion mode. High speed torque correction is provided when torque demand control (such as the control described in connection with FIG. 7) is used to control the throttle position. Also, the invention widens the range (dynamic range) over which torque can be controlled during homogeneous combustion. It is possible to realize a response during stratified combustion that is about as fast as the response during homogeneous combustion, without increasing the processing load required for calculations during high speed operations. Also, the same response characteristics for operations with stratified and homogeneous combustion can be used over the entire range of engine speed.

DETAILED DESCRIPTION OF PREFERRED EMBODIMENTS OF THE INVENTION

Figure 1A:
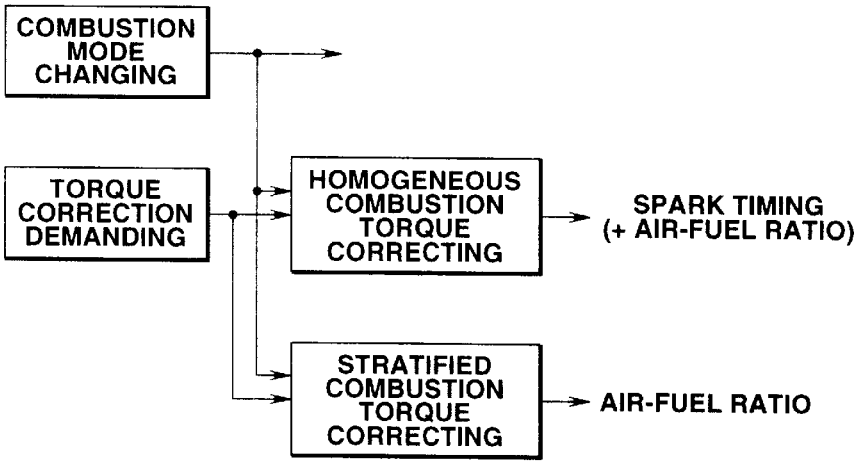
FIGS. 1(A) and 1(B) illustrate block diagrams showing the overall arrangement of the invention.
Figure 1B:
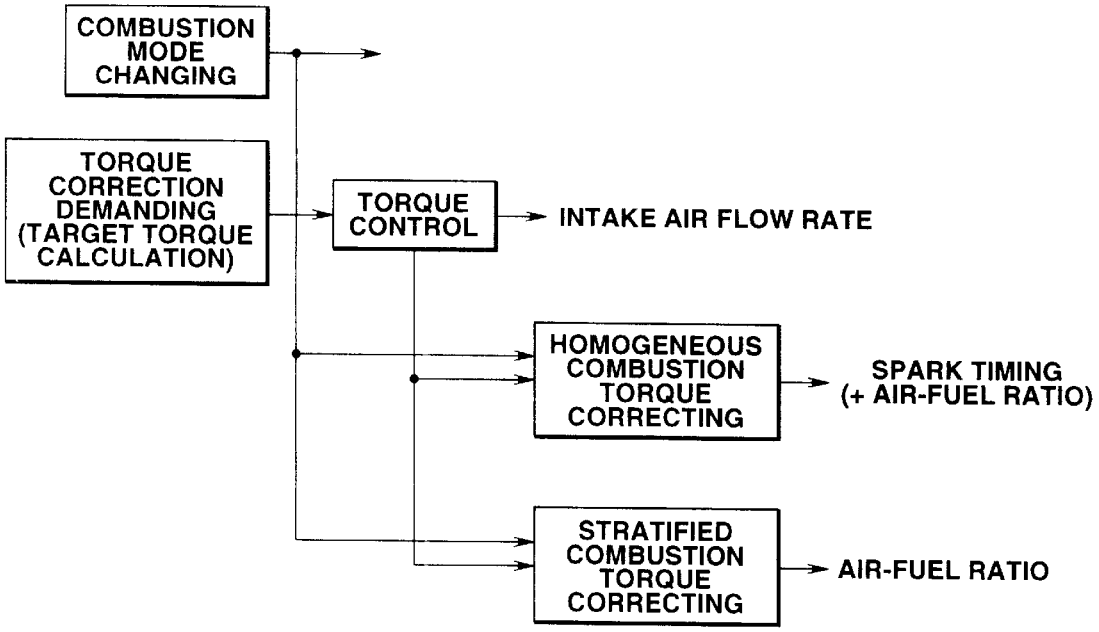

FIGS. 1(A) and 1(B) will be used to explain the overall design of the invention.

The invention is directed to a control apparatus, or controller, for a direct-injection spark-ignition type engine. As shown in FIG. 1(A), the invention includes a combustion mode changing section for making a combustion change between homogenous combustion (wherein fuel is injected during an intake stroke to diffuse the injected fuel so as to form a homogeneous mixture in the combustion chamber) and stratified combustion (wherein fuel is injected during a compression stroke to form a stratified fuel mixture around the spark plug). The invention includes a torque correction demanding section for producing a torque correction demand in accordance with engine operating conditions. The controller also includes a homogenous combustion torque correcting section, which is responsive to the torque correction demand, for correcting at least the spark timing in order to make a torque correction during homogenous combustion. A stratified combustion torque correcting section is responsive to a torque correction demand and corrects at least the air-fuel ratio in order to make a torque correction during stratified combustion.

FIG. 1(B) shows another overall arrangement of the invention. This arrangement is also directed to a controller for a direct-injection spark-ignition type engine. This design also includes a combustion mode changing section for making a combustion mode change between homogenous combustion and stratified combustion. A torque correction demanding section produces a torque correction demand based on engine operating conditions. A torque control section is responsive to the torque correction demand and controls the amount of air permitted to enter the engine in order to control the torque. Because air intake cannot be changed rapidly, a homogenous combustion torque correcting section corrects at least the spark timing in order to make a torque correction with a fast response (compared with the delay associated with intake air flow rate control) during homogenous combustion. A stratified combustion torque correcting section corrects at least the air-fuel ratio to make torque correction during stratified combustion.

Figure 2:
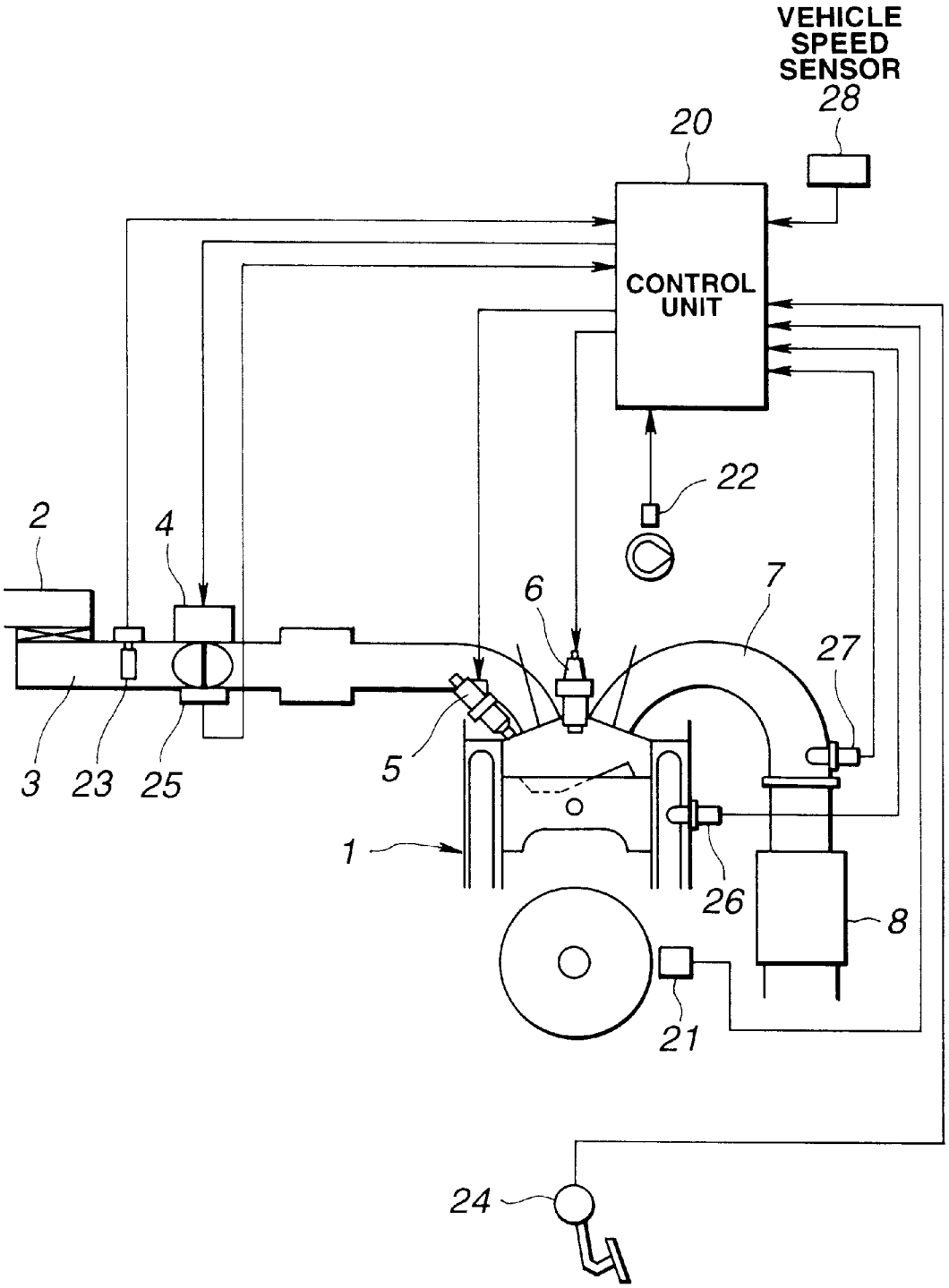
FIG. 2 is a system diagram of an engine embodying the invention.

FIG. 2 is a system diagram showing a direct-injection spark-ignition engine embodying the invention. Air is introduced through an air cleaner 2 into an intake passage 3 and hence into each of the combustion chambers of engine 1 (installed in a vehicle). Air intake is controlled by an electronic controlled throttle valve 4. The degree of opening of the electronic controlled throttle valve 4 is controlled by, for example, a step motor operable in response to a signal from a control unit 20.

An electro-magnetic fuel injector 5 is provided for direct injection of fuel (gasoline) into the combustion chamber. The fuel injector 5 opens to inject fuel adjusted at a predetermined pressure when its solenoid receives a fuel injection pulse signal outputted from the control unit 20 during an intake or compression stroke, in synchronism with engine rotation, to inject fuel. In the case where the fuel is injected during the intake stroke, the injected fuel diffuses into the combustion chamber to form a homogeneous mixture. In the case where the fuel is injected during the compression stroke, a stratified mixture is formed around a spark plug 6. The spark plug 6 produces a spark to ignite the mixture for combustion (homogeneous combustion or stratified combustion). The combustion modes include homogeneous stoichiometric combustion (at an air-fuel ratio of about 14.6), homogeneous lean combustion (at air-fuel ratios ranging from about 20 to 30), and stratified lean combustion (at air-fuel ratios of about 40), in accordance with air-fuel ratio control. Additional discussion regarding homogeneous combustion and stratified combustion and regarding how the air-fuel ratio can be adjusted for various engine operating conditions is set forth in U.S. patent application Ser. No. 08/901,963, filed Jul. 29, 1997 entitled "Control System for Internal Combustion Engine," and a U.S. Patent Application entitled "Direct Injection Gasoline Engine with Stratified Charge Combustion and Homogeneous Charge Combustion" filed under Attorney Docket No. 040679/625. The entire contents of these applications are incorporated herein by reference.

The exhaust gases discharge from the engine 1 into exhaust passage 7. The exhaust passage 7 has a catalytic converter 8 for purifying the exhaust gases.

The control unit, or controller, 20 includes a microcomputer comprised of a CPU, a ROM, a RAM, an A/D converter and an input/output interface and receives signals from various sensors. One suitable control unit is, for example, a Hitachi SH70 series processor, programmed in C and/or machine language. The sections described herein are implemented in hardware, software, or a combination of both, in the control unit 20.

These sensors include angle sensors 21 and 22 for detecting the rotation of the crankshaft or camshaft of the engine 1. The sensors 21 and 22 produce a reference pulse signal REF for each 720°/n of rotation of the shaft (where n is the number of cylinders) at a predetermined shaft position (at a predetermined crankshaft angular position before the compression top dead center of each of the cylinders) and also a unit pulse signal POS at a predetermined number of degrees (1 to 2°) of rotation of the shaft. The engine speed Ne is calculated based on the period of the reference pulse signal REF.

The sensors also include an airflow meter 23 provided in the intake passage 3 at a position upstream of the throttle valve 4 for detecting the intake air flow rate Qa (the amount of air permitted to enter the engine); an accelerator sensor 24 for detecting the accelerator position ACC (the degree to which the accelerator is depressed); a throttle valve sensor 25 (including an idle switch positioned to be turned on when the throttle valve 4 is fully closed) for detecting the degree TVO of opening of the throttle valve 4; a coolant temperature sensor 26 for detecting the temperature Tw of the coolant of the engine 1; an $O_2$ sensor 27 positioned in the exhaust passage 7 for producing a signal corresponding to the rich/lean composition of the exhaust gas for actual air-fuel ratio determination; and a vehicle speed sensor 28 for detecting the vehicle speed VSP.

The control unit 20 receives the signals fed thereto from the various sensors and includes a microcomputer built therein for making the calculations described herein to control the degree of opening of the electronic controlled throttle valve 4, the amount of fuel injected to the engine by the fuel injector 5, and the spark timing of the spark plug 6.

Torque control (torque correction) will be described with reference to the flow diagrams.

First Embodiment

A first embodiment will be described with reference to the flow diagrams of FIGS. 3 to 5.

Figure 3:
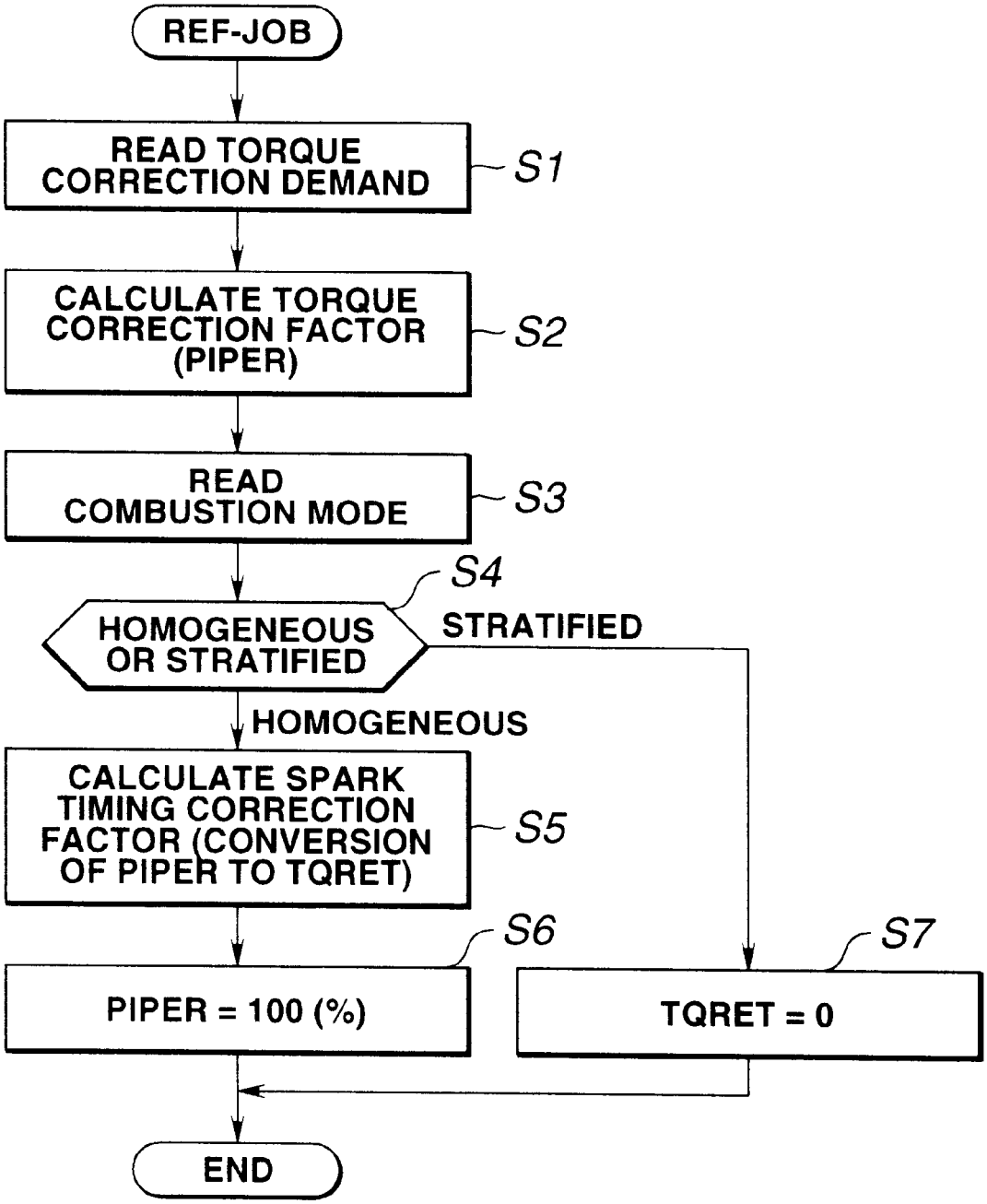
FIG. 3 is a flow diagram showing a torque correction factor calculating routine used in a first embodiment.

FIG. 3 shows a torque correction factor calculating routine executed in synchronism with the reference pulse signal REF (REF-JOB).

In step S1, a torque correction demand (that is, a demand for an increase or decrease in engine torque), which can result from, for example, a gear shift operation, air conditioner turning on operation, or fuel cut recovery, is read. For example, a torque decreasing demand is produced during a gear shift operation; a torque increasing demand is produced when the air conditioner is turned on; and a torque decreasing demand is produced upon fuel cut recovery. Examples of torque correction demand will be described in further detail below in connection with FIGS. 20 to 22.

In step S2, a torque correction factor PIPER (100±α%) is calculated in accordance with the torque correction demand. More specifically:

$$PIPER = \frac{tTeO + \Delta tTe}{tTeO}$$

wherein tTeO is basic target engine torque and ΔtTe is the torque correction value. No correction is made when PIPER=100%. A torque increasing demand is when PIPER>100% and a torque decreasing demand is when PIPER<100%.

In step S3, the combustion mode is read. The combustion mode is changed based on engine operating conditions using combustion mode changing maps such as a map which defines the combustion mode (and basic equivalence ratio tϕ or air-fuel ratio) as a function of engine speed Ne and the target engine torque tTe. Maps are prepared for each engine operating condition as defined by, for example, coolant temperature Tw, the time elapsed after the engine starts, and the like. One of homogeneous stoichiometric combustion, homogeneous lean combustion, and stratified lean combustion is set based on the actual engine operating conditions from the map selected according to these conditions. An example of this process will be described below in connection with FIG. 23.

In step S4, a determination is made as to whether the combustion mode is homogeneous combustion (homogeneous stoichiometric combustion or homogeneous lean combustion) or stratified combustion (stratified lean combustion).

Figure 24:
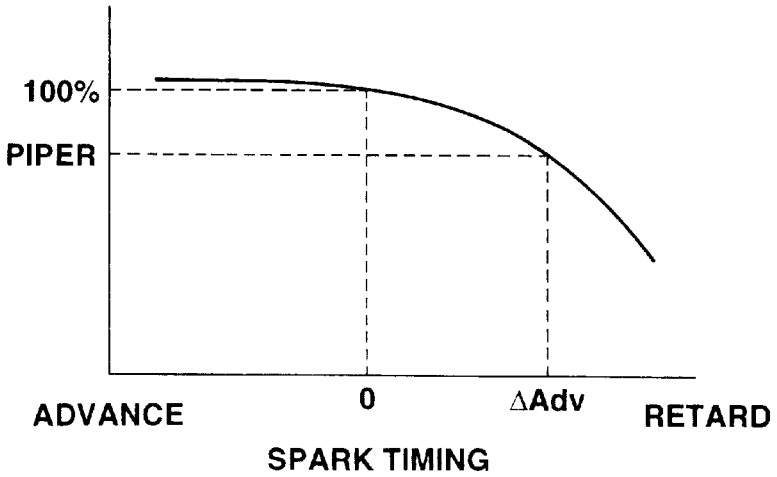
FIGS. 24 to 27 are examples of maps employed in the invention.

If the combustion mode is homogeneous combustion, then the program proceeds to step S5 where the torque correction factor PIPER is converted into a spark timing correction factor TQRET according to, for example, a map such as shown in FIG. 24 (TQRET=ΔAdv). As shown in FIG. 24, since advancing the spark timing increases the torque little, the basic spark timing is set retarded in order to obtain a enough torque increase when the spark timing is advanced. The spark timing correction factor TQRET has a positive sign when the spark timing is to be retarded and a negative sign when the spark timing is to be advanced. In step S6, the torque correction factor PIPER is returned to 100% and this routine is ended.

If the combustion mode is stratified combustion, then the program proceeds to step S7 wherein the spark timing correction factor TQRET is set at zero (TQRET=0) and this program is ended. In this case, the torque correction factor PIPER is held at the value calculated in step S2. In one embodiment, the calculations in FIG. 3 take several microseconds.

Figure 4:
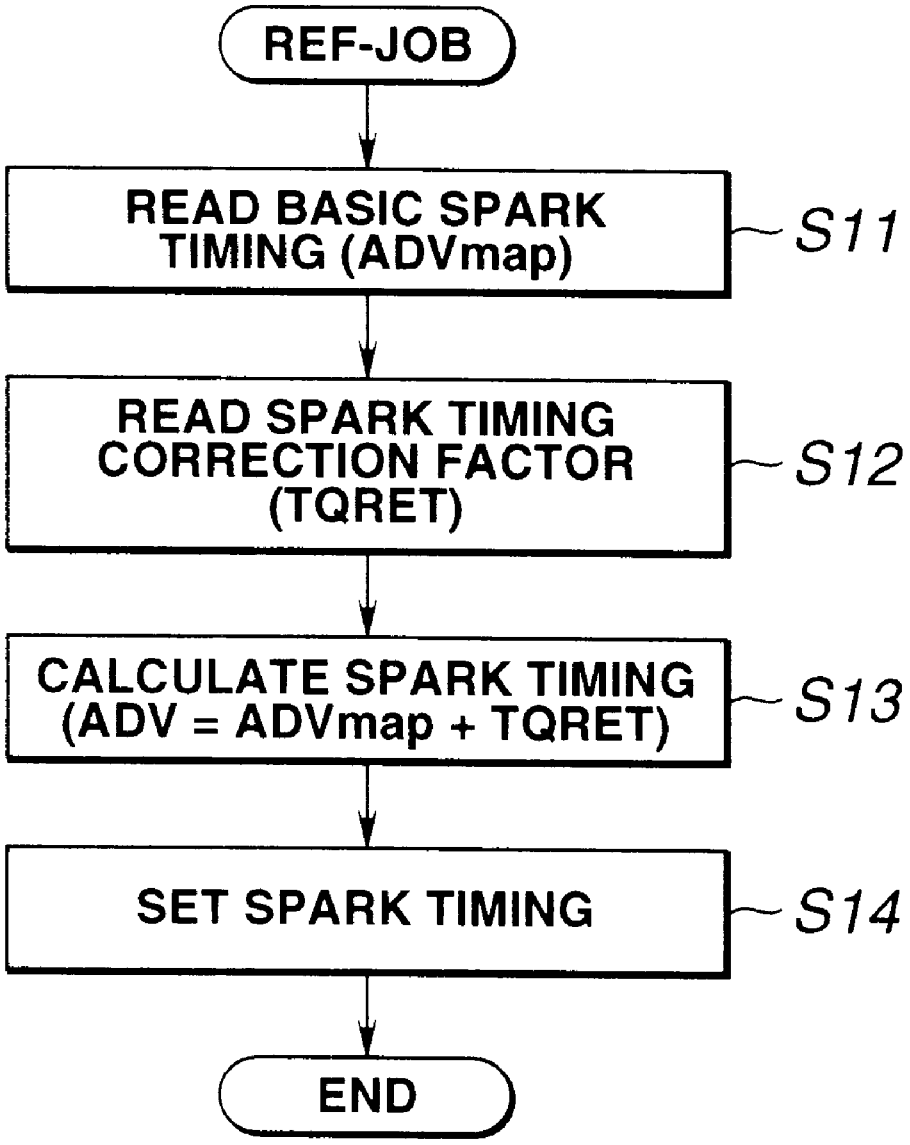
FIG. 4 is a flow diagram showing a spark timing calculating routine used in the first embodiment.

FIG. 4 shows a spark timing calculating routine executed in synchronism with the reference pulse signal REF (REF-JOB).

Figure 25:
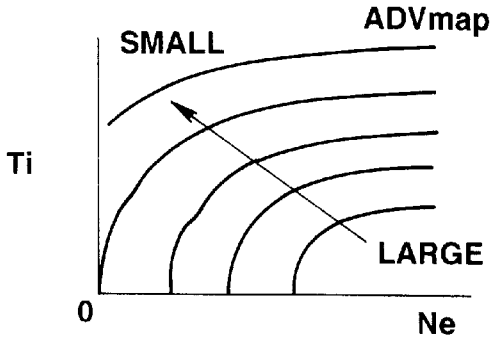

In step S11, the basic spark timing ADVmap is obtained. The basic spark timing ADVmap for homogeneous combustion [both stoichiometric and lean] is calculated in accordance with MBT control such as disclosed in U.S. Pat. No. 5,070,842. The basic spark timing ADVmap for stratified charge combustion is calculated from a prepared map. FIG. 25 shows an ADVmap for stratified charge combustion which defines the basic spark timing ADVmap as a function of engine speed Ne and fuel delivery, more particularly pulse width for fuel delivery Ti. In FIG. 25, the target torque tTe can also be used instead of fuel delivery Ti.

Figure 26:
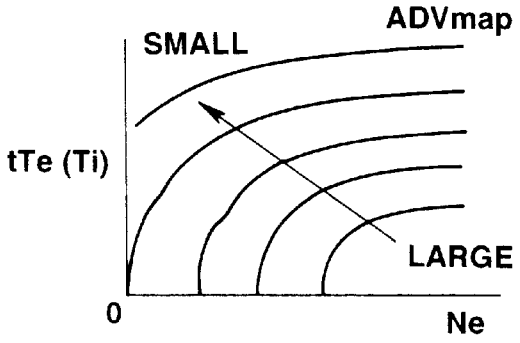

The spark timing ADVmap for homogeneous combustion can be calculated in accordance with a map as a function of engine speed Ne and one the target torque tTe and fuel delivery Ti (see FIG. 26)

In step S12, the spark timing correction factor TQRET (from the FIG. 3 processing) is read. In step S13, the spark timing correction factor TQRET is added to the basic spark timing ADVmap to calculate the eventual spark timing ADV:

$$ADV=ADVmap+TQRET$$

Since the torque correction factor PIPER is converted to the spark timing correction factor TQRET during homogeneous combustion, this torque correction reflects on the spark timing ADV, and the torque is corrected by adjusting the spark timing. Since the spark timing correction factor TQRET is zero during stratified combustion, no torque correction is made via the spark timing during stratified combustion.

In step S14, the spark timing ADV is set in a predetermined register and a command is produced to generate a spark at the spark timing ADV.

Figure 5:
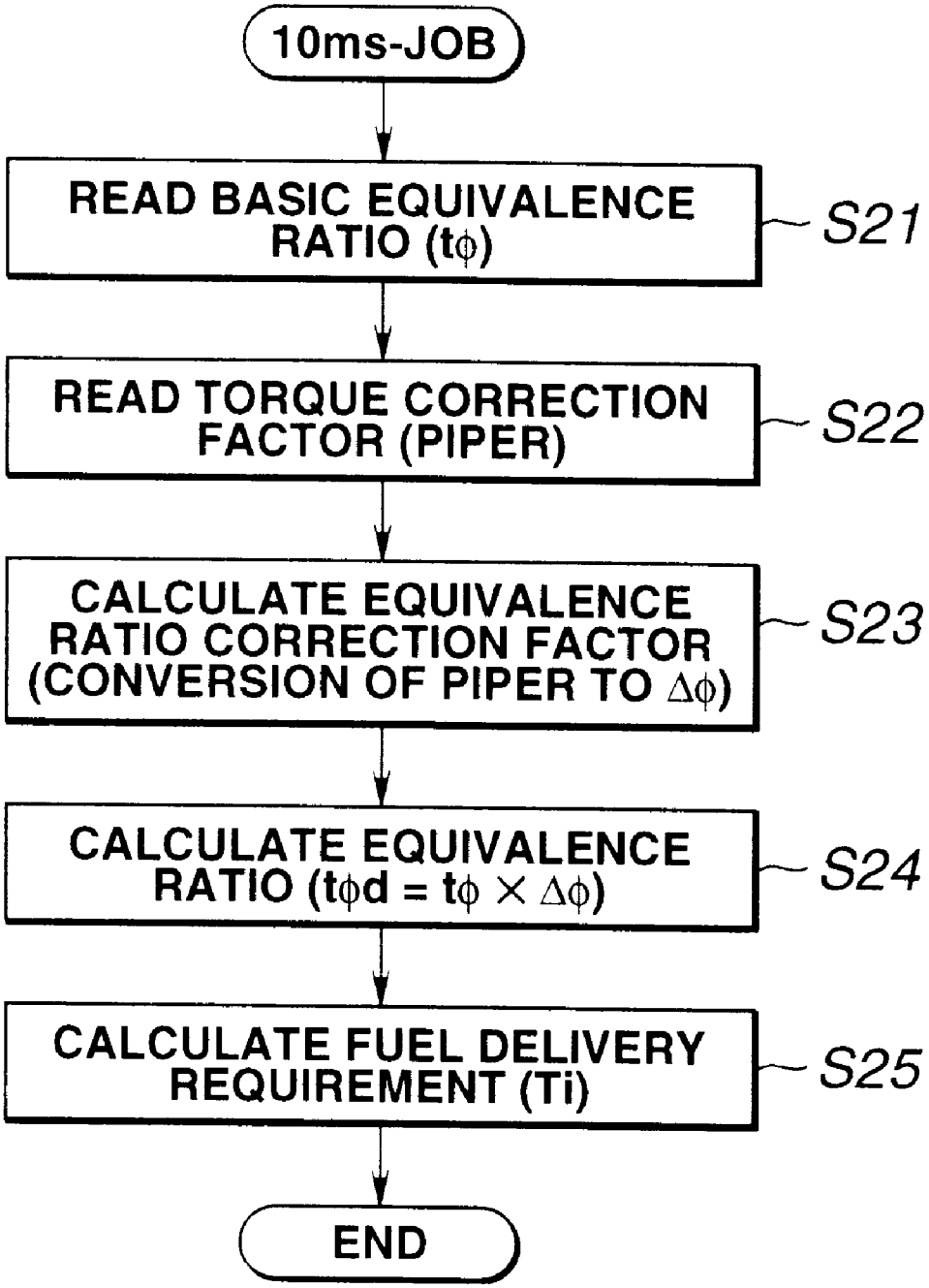
FIG. 5 is a flow diagram showing a fuel delivery requirement calculating routine used in the first embodiment.

FIG. 5 shows a fuel delivery requirement calculating routine executed at uniform intervals of time, for example, 10 ms (10 ms-JOB).

In step S21, a basic equivalence ratio tϕ (set during execution of another routine for air-fuel ratio control) is read. The basic equivalence ratio tϕ is set according to the combustion mode, as discussed above. The term "equivalence ratio" means a fuel-air ratio represented as 14.6/AFR, where AFR is the air-fuel ratio. An example of this processing will be described in connection with FIG. 23.

In step S22, the torque correction factor PIPER is read.

Figure 27:
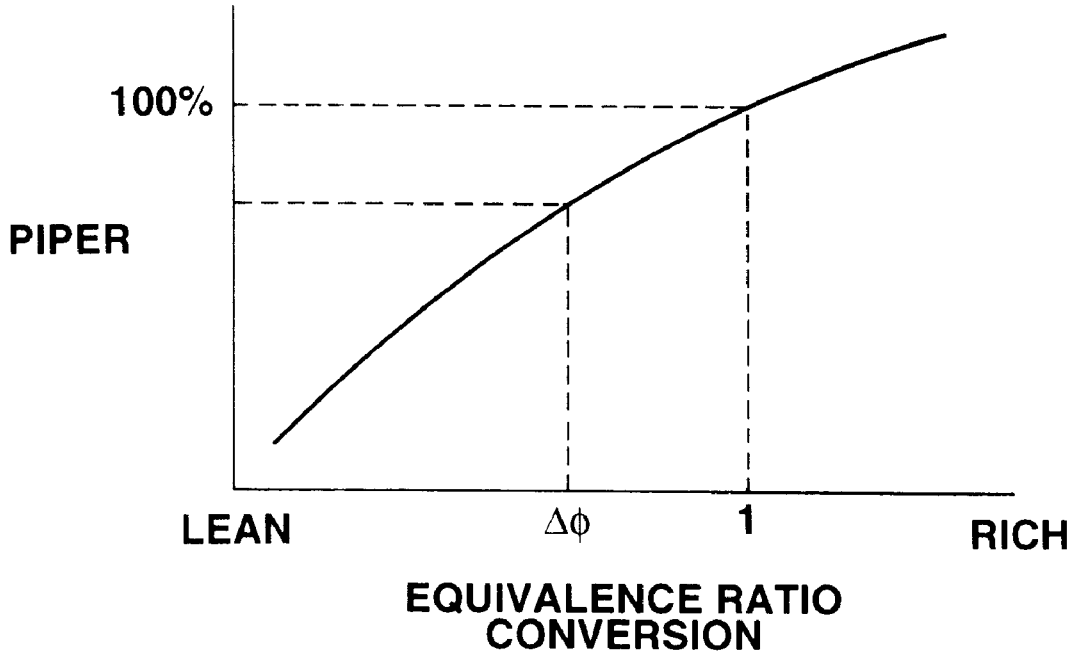

In step S23, the torque correction factor PIPER is converted to an equivalence ratio correction factor Δϕ. Since the torque correction factor PIPER is 100% during homogeneous combustion (in this embodiment), the equivalence ratio correction factor Δϕ is 1 in this case. Since the torque correction factor PIPER is 100±α% during stratified combustion, the equivalence ratio correction factor Δϕ is 1±β. FIG. 27 shows one suitable map for converting PIPER to Δϕ.

In step S24, the target equivalence ratio tϕd is calculated by multiplying the basic equivalence ratio tϕ by the equivalence ratio correction factor Δϕ:

$$t\phi d=t\phi\times\Delta\phi$$

In step S25, the basic fuel delivery requirement Tp is corrected for the target equivalence ratio tϕd and the like to calculate the eventual fuel delivery requirement Ti as follows:

$$Ti=Tp\times t\phi d\times K\alpha+Ts$$

Tp is the basic fuel delivery requirement corresponding to the stoichiometric air-fuel ratio, Tp=K1×Qa/Ne (K1 is a constant).

Kα is an air-fuel ratio feedback correction factor calculated based on the $O_2$ sensor signal (the correction factor Kα is clamped at 1 during lean combustion).

Ts is an ineffective injection time correction factor dependent on the battery voltage.

The fuel delivery requirement Ti calculated in such a manner is set in a predetermined register. An injection pulse signal having a pulse width corresponding to the fuel delivery requirement Ti is outputted to each of the fuel injectors 5 for fuel injection in the intake stroke of the corresponding cylinder (during homogeneous combustion) and in the compression stroke of the corresponding cylinder (during stratified combustion).

Thus, the steps S1 to S4, S5, S6, S12 and S13 perform a homogeneous combustion torque correcting function and the steps S1 to S4, S7, and S22 to S25 perform a stratified combustion torque correcting function.

Figure 12:
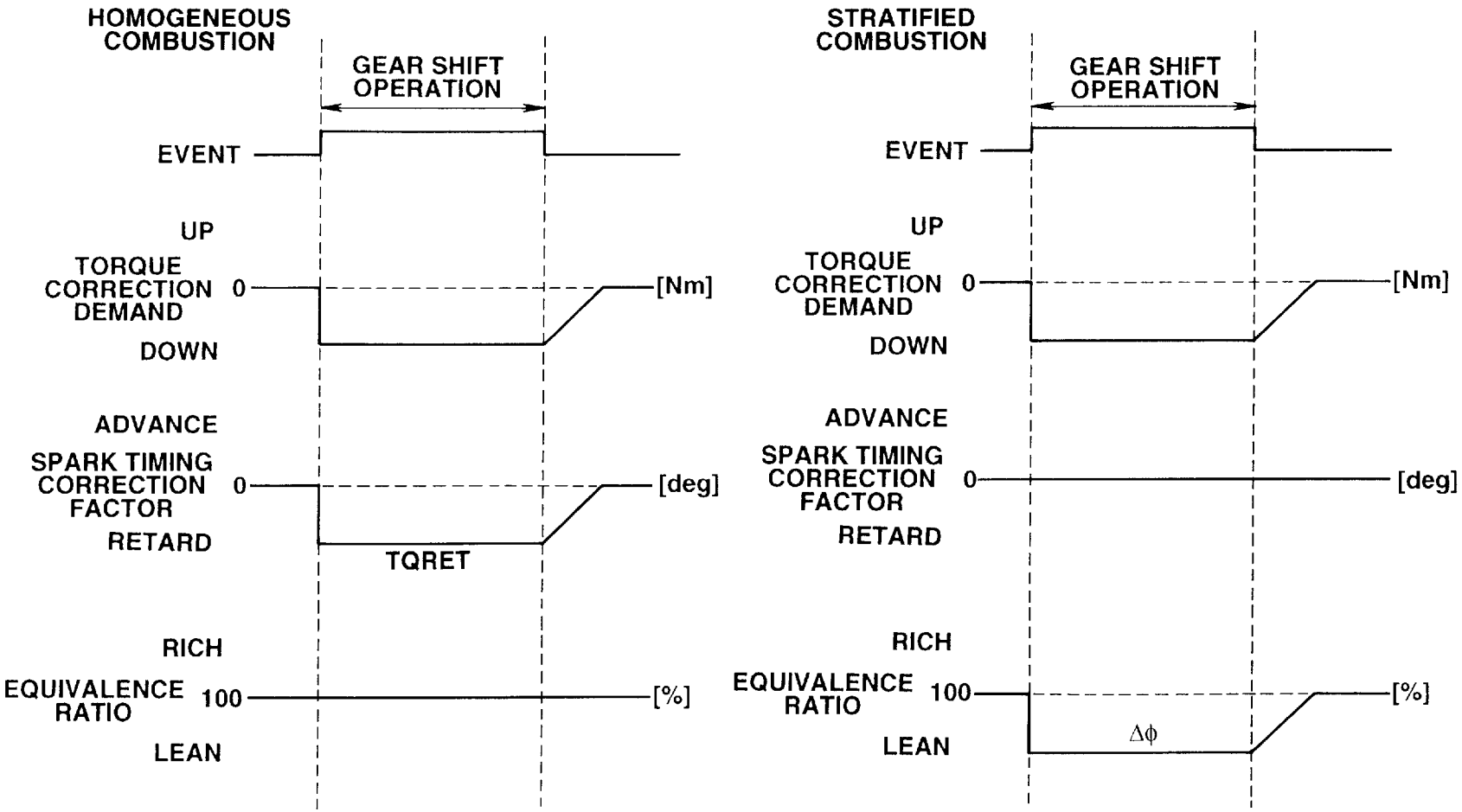
FIG. 12 shows response waveforms for the first embodiment.

FIG. 12 shows response waveforms for the first embodiment of the invention. Assuming that a demand for torque correction (torque down demand) is produced in the presence of a gear shift, the spark timing is corrected to correct the torque during homogeneous combustion, whereas the equivalence ratio (air-fuel ratio) is corrected, without correcting the spark timing, to correct the torque during stratified combustion.

In this embodiment, the electronic controlled throttle valve 4 is controlled according to the accelerator position ACC.

Second Embodiment

Figure 6:
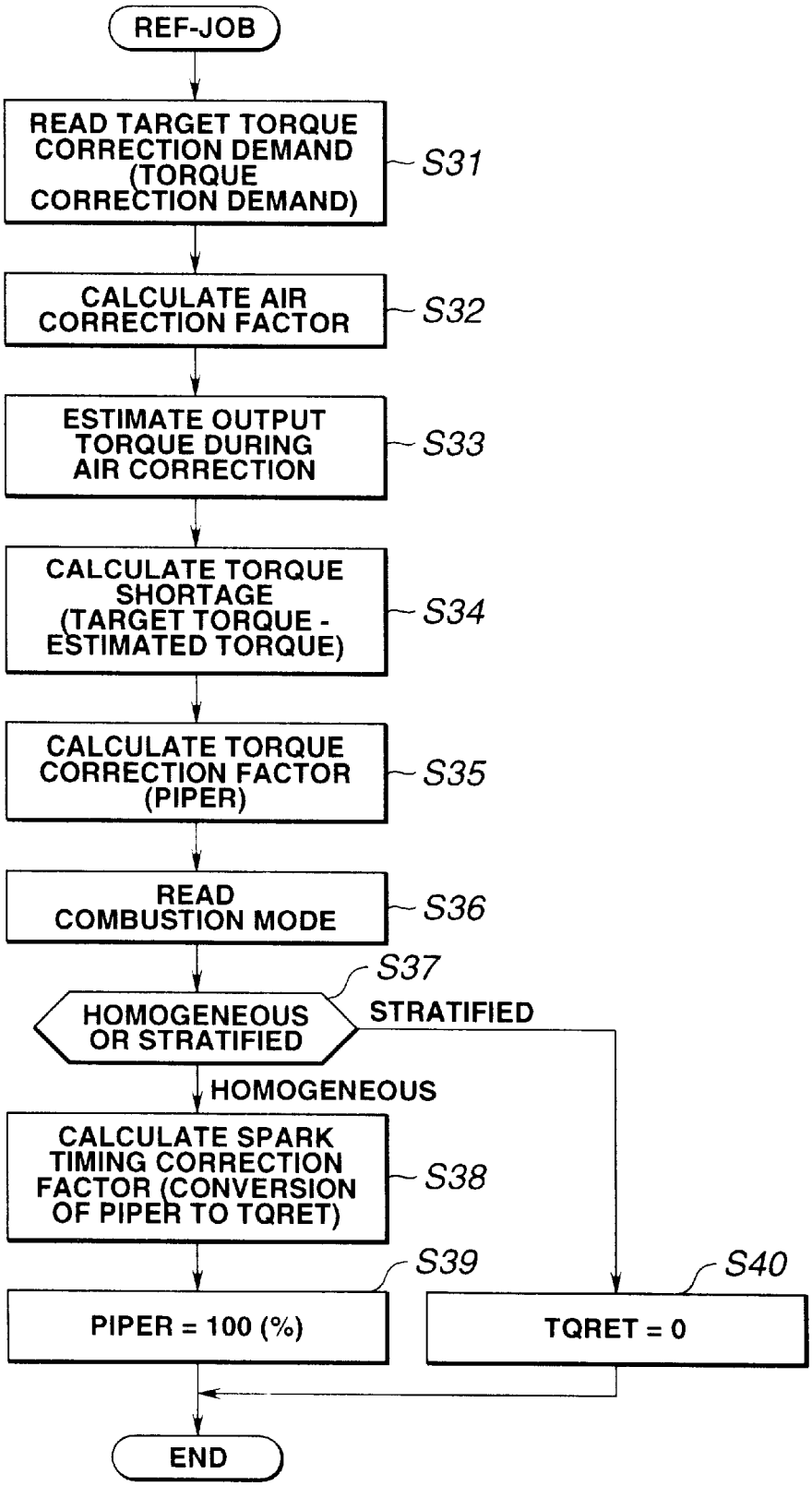
FIG. 6 is a flow diagram showing a torque correction factor calculating routine used in a second embodiment.

In the second embodiment, torque correction is made as shown in FIG. 6, and spark timing and fuel delivery requirement calculations are made as described above in connection with FIGS. 4 and 5.

FIG. 6 shows a torque correcting routine executed in synchronism with the reference pulse signal REF (REFJOB).

At step S31, a target torque tTRQ calculated by torque demand control is retrieved. The parameter tTRQ includes a torque correction demand (demand for increasing or decreasing the torque) resulting from gear shifting of the transmission, turning on the air conditioner, recovery from a fuel cut, or the like.

The target torque is represented by the following formula:

$$\text{Target torque } tTE\ (=tTRQ) = \text{basic target engine torque } (tTeO) + \text{torque correction for intake air } (\Delta tTe_air)$$

In the second and fourth embodiments, torque correction entails correction for the intake air amount. This torque correction is indicated by ΔtTe_air.

In step S32, an air correction factor to obtain the target torque (the torque correction demand) is calculated to control the degree of opening of the electronic controlled throttle valve 4.

In step S33, the output torque during intake air correction is estimated.

In step S34, the estimated torque is subtracted from the target torque (which is based on the torque demand control target torque or the torque correction demand calculated at step S31) to calculate the torque shortage due to the delay involved with changing the amount of intake air.

In step S35, a torque correction factor PIPER (100±α%) is calculated in accordance with the torque shortage. In this case, PIPER=100% indicates no correction. PIPER>100% indicates a torque increase demand, and PIPER<100% indicates a torque decrease demand.

In step S36, the combustion mode is read.

In step S37, a determination is made as to whether the combustion mode is homogeneous combustion (homogeneous stoichiometric combustion or homogeneous lean combustion) or stratified combustion (stratified lean combustion).

If the combustion mode is homogeneous combustion, then the program proceeds to step S38 wherein the torque correction factor PIPER is converted to a spark timing correction factor TQRET, as discussed above. The spark timing correction factor TQRET has a positive sign when the spark timing is to be retarded and a negative sign when the spark timing is to be advanced. In step S39, the torque correction factor PIPER is returned to 100% and this program is ended.

If the combustion mode is stratified combustion, then the program proceeds to step S40 wherein the spark timing correction factor TQRET is set at 0 and this program is ended. In this case, the torque correction factor is held at the value calculated in step S35.

Thereafter, control is made according to the spark timing calculation routine of FIG. 4 and the fuel delivery requirement calculation routine of FIG. 5.

The steps S31 to S37, S38, S39, S12 and S13 perform a homogeneous combustion torque correcting function and the steps S31 to S37, S40 and S22 to S25 perform a stratified combustion torque correcting function.

Figure 7:
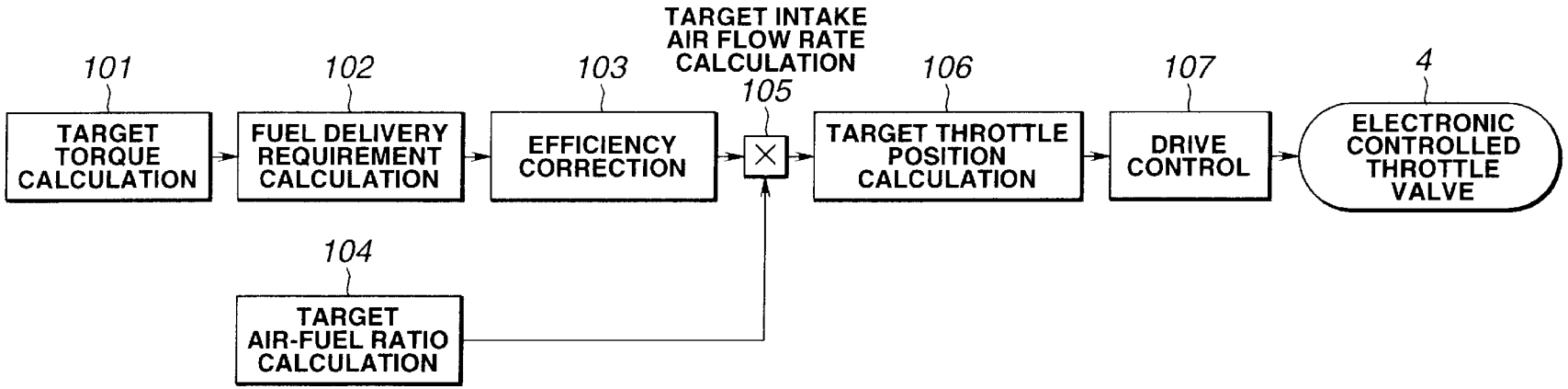
FIG. 7 is a block diagram showing torque demand control used in the second embodiment.

FIG. 7 is a control block diagram for torque demand control.

A target torque calculation section 101 receives the accelerator position ACC and the engine speed Ne, and outputs a driver demand torque based on a predetermined map which defines the driver demand torque as a function of accelerator position and engine speed. A torque correction demand factor resulting from a gear shift, air conditioner on, fuel cut recovery, or the like is added to the driver demand torque to calculate a target torque tTRQ.

A basic fuel delivery requirement calculation section 102 receives the target torque tTRQ and the engine speed Ne and it outputs a basic fuel delivery requirement tQf based on a predetermined map which specifies the basic fuel delivery requirement tQf as a function of target torque and engine speed.

The combustion efficiency varies when the air-fuel ratio changes over a wide range during operation with homogeneous and stratified combustion. An efficiency correction section 103 corrects the basic fuel delivery requirement tQf based on combustion efficiency. The basic fuel delivery is corrected less as the air/fuel ratio increases (leaner). Under lean conditions, the pumping loss is lower and efficiency is higher; thus less fuel is needed to get a certain torque when the air fuel ratio is leaner.

A target air-fuel ratio calculation section 104 receives the target torque tTRQ and the engine speed Ne and outputs a target air-fuel ratio tAFR from a predetermined map which defines the target air-fuel ratio tAFR as a function of target torque and engine speed.

A target intake air flow rate calculation section 105 includes a multiplier which multiplies the basic fuel delivery requirement tQf by the target air-fuel ratio tAFR to calculate a target intake air flow rate tQcyl=tQf×tAFR.

A target throttle position calculation section 106 receives the target intake air flow rate tQcyl and the engine speed Ne and outputs a target throttle position tTVO from a predetermined map which specifies the target throttle position tTVO as a function of tQcyl and Ne.

A throttle valve drive control section 107 drives, for example, a step motor in a stepped manner in response to a command signal corresponding to the target throttle position tTVO so as to bring the throttle valve 4 to the target throttle position tTVO. Examples of maps referred to above in connection with FIG. 7 are shown in a U.S. Patent Application entitled "Engine Throttle Control Apparatus" and filed under Attorney Docket No. 040679/0629.

Figure 13:
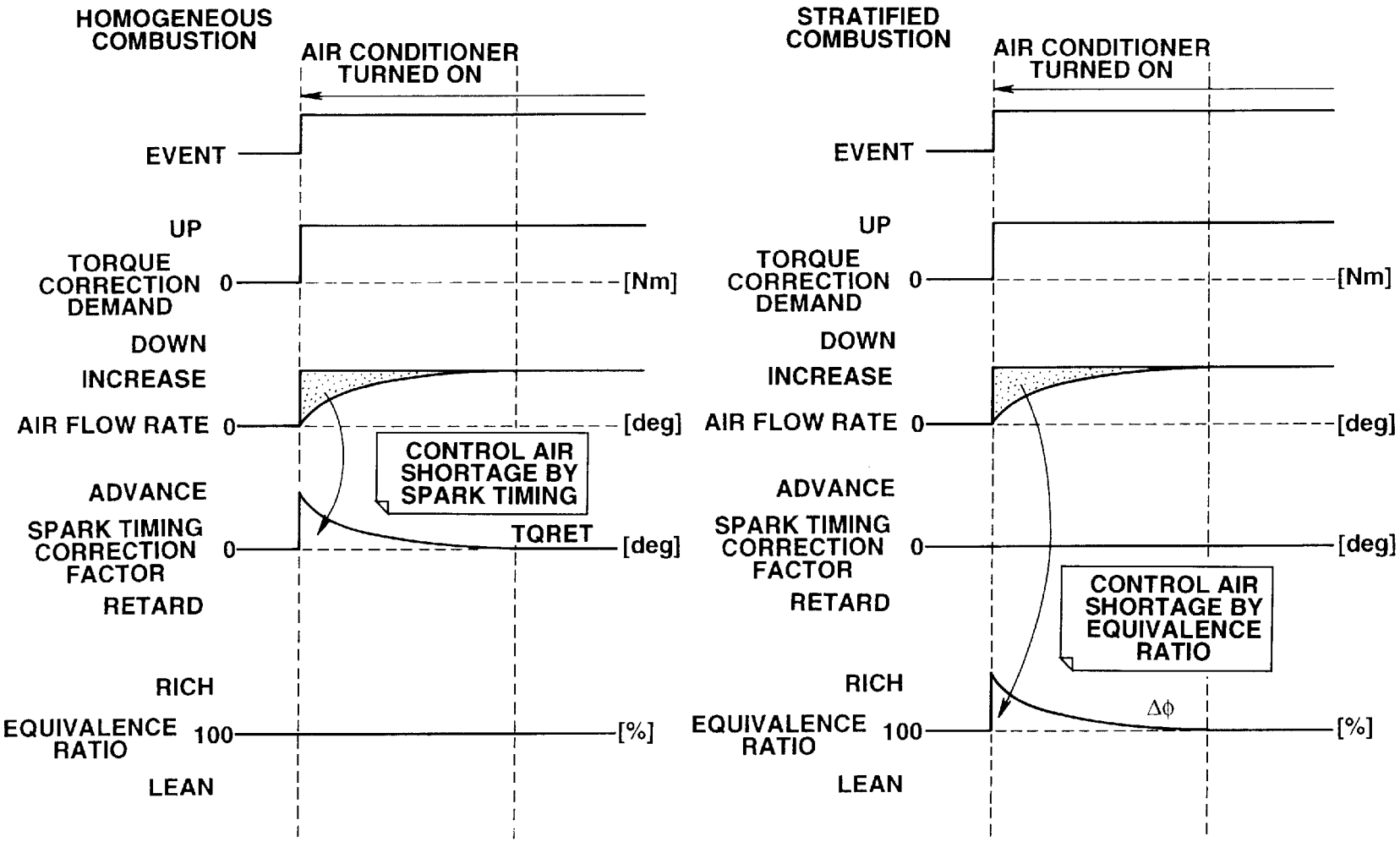
FIG. 13 shows response waveforms for the second embodiment.

FIG. 13 shows response waveforms for the second embodiment. Assuming that a torque correction (torque up) demand is produced when the air conditioner is turned on, the amount of air to the engine increases; however, a torque shortage occurs because of the delay in increasing the actual amount of air to the engine. The spark timing is corrected to correct the torque shortage during homogeneous combustion and the equivalence ratio (air-fuel ratio) is corrected, without correcting the spark timing, to correct the torque shortage during stratified combustion.

Third Embodiment

Figure 8:
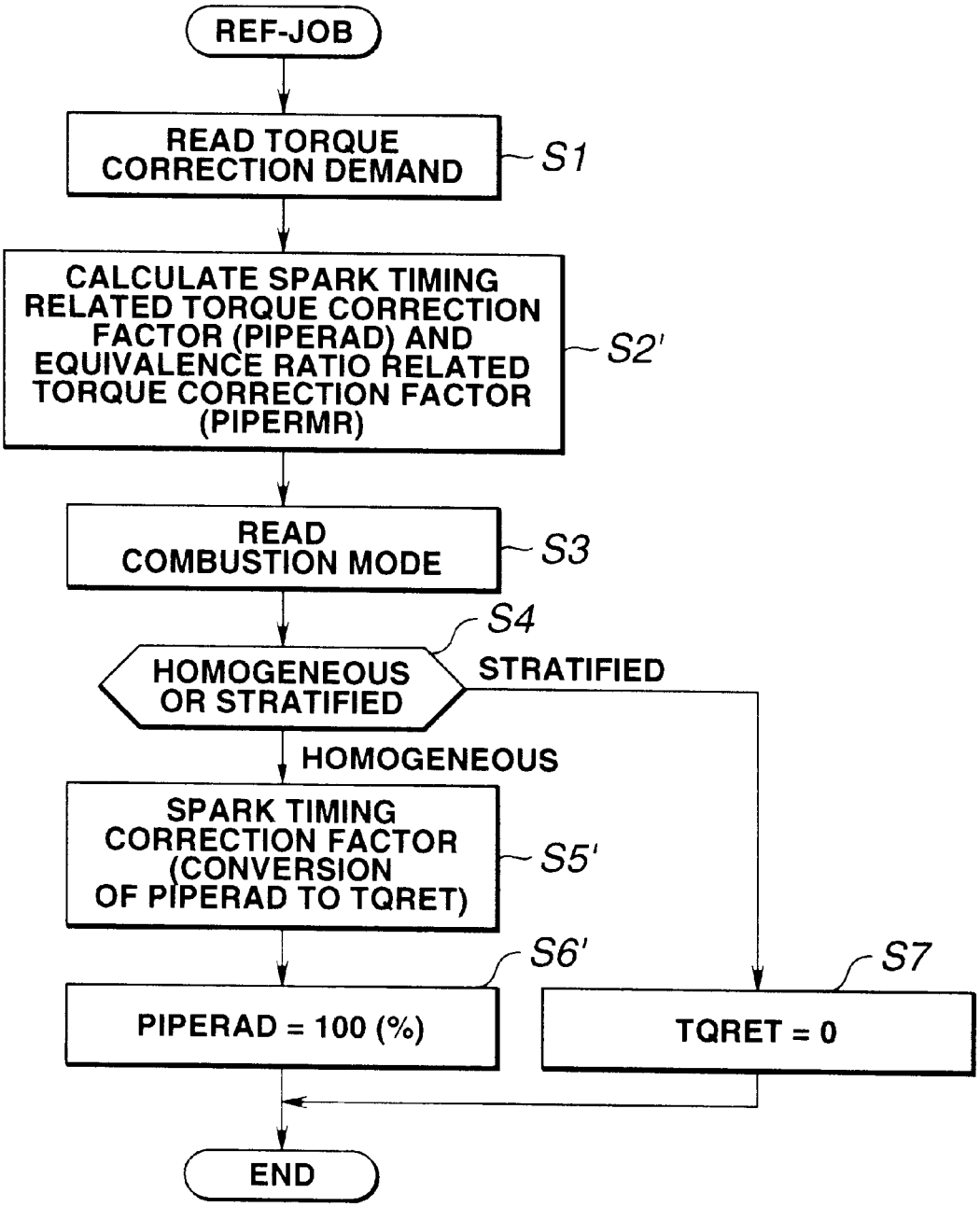
FIG. 8 is a flow diagram showing a torque correction factor calculating routine used in a third embodiment.
Figure 9:
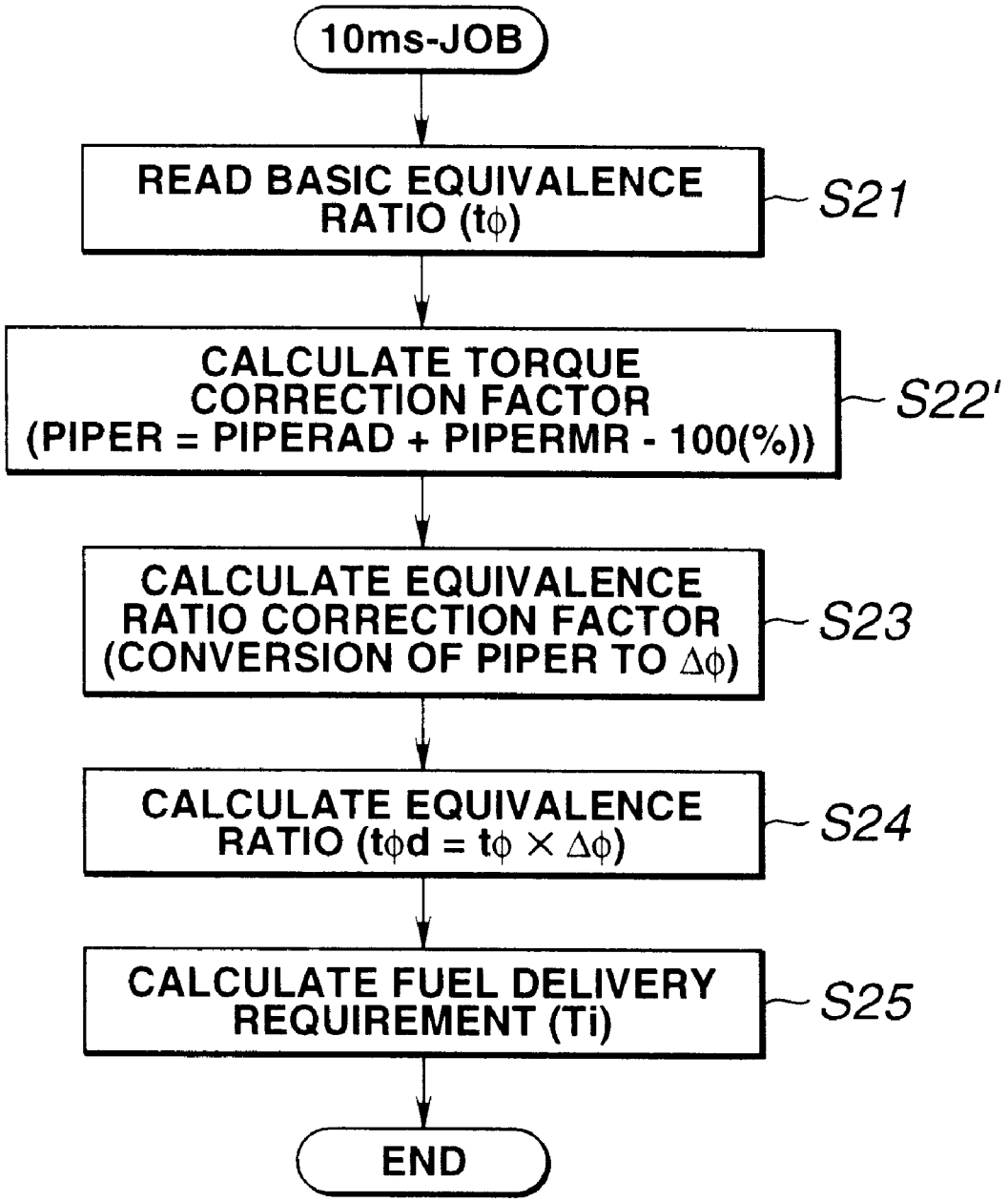
FIG. 9 is a flow diagram showing a fuel delivery requirement calculating routine used in the third embodiment.

In the third embodiment, the torque correction factor calculation is made as shown in FIG. 8, the spark timing calculation is made as described above in connection with FIG. 4, and the fuel delivery requirement calculation is made as shown in FIG. 9.

FIG. 8 shows a torque correction factor calculating routine executed in synchronism with the reference pulse signal REF (REF-JOB). FIG. 8 is different from FIG. 3 in steps S2', S5' and S6'.

In step S1, a torque correction demand (increase or decrease demand) resulting from a gear shift, air conditioner on, fuel cut recovery, or the like, is read.

In step S2, a torque correction factor is calculated in accordance with the torque correction demand. The torque correction factor is divided into a spark timing related torque correction factor PIPERAD and an air-fuel ratio related torque correction factor PIPERMR, which are independently calculated. When each correction factor is ΔtTe_AD, ΔtTe_MR:

$$PIPERAD = \frac{tTeO + \Delta tTe_{AD}}{tTeO}$$

In this case, 100% indicates no correction, greater than 100% indicates a torque increase demand, and less than 100% indicates a torque decrease demand.

In step S3, the combustion mode is read.

In step S4, a determination is made as to whether the combustion mode is homogeneous combustion (homogeneous stoichiometric combustion or homogeneous lean combustion) or s t ratified combustion (stratified lean combustion).

If the combustion mode is homogeneous combustion, then the program proceeds to the step S5' wherein the spark timing related torque correction factor PIPERAD is converted to a spark timing correction factor TQRET in accordance with FIG. 24. (TQRET=ΔAdv). The spark timing correction factor TQRET has a positive sign when the spark timing is to be retarded and a negative sign when the spark timing is to be advanced. In step S6', the spark timing related torque correction factor PIPERAD is returned to 100% and this program is ended.

If the combustion mode is stratified combustion, then the program proceeds to step S7, where the spark timing correction factor TQRET is set at 0. In this case, the spark timing related torque correction factor PIPERAD is held at the value calculated in step S2'.

Thereafter, control is made according to the spark timing calculation routine of FIG. 4.

FIG. 9 shows a fuel injection requirement calculating routine executed at uniform intervals of time, for example, 10 ms (10 ms-JOB). FIG. 9 is different from FIG. 5 in step S22'.

In step S21, a basic equivalence ratio tϕ for air-fuel ratio control is read.

In step S22', the spark timing related torque correction factor PIPERAD and the equivalence ratio related torque correction factor PIPERMR are read and added to calculate a total torque correction factor PIPER as follows:

$$PIPER = PIPERAD + PIPERMR - 100(\%)$$

Since the spark timing related torque correction factor PIPERAD 100% during homogeneous combustion (after execution of FIG. 8), PIPER=PIPERMR during homogeneous combustion.

In step S23, the torque correction factor PIPER is converted to an equivalence ratio correction factor Δϕ.

In step S24, the equivalence ratio correction factor Δϕ is multiplied by the basic equivalence ratio tϕ to calculate a target equivalence ratio tϕd as follows:

$$t\phi d = t\phi \times \Delta\phi$$

In step S25, the basic fuel delivery requirement Tp is corrected based on the target equivalence ratio tϕd to calculate an eventual fuel delivery requirement Ti:

$$Ti = Tp \times t\phi d \times K\alpha + Ts$$

The fuel delivery requirement Ti calculated in such a manner is set in a predetermined register. An injection pulse signal having a pulse width corresponding to the fuel delivery requirement Ti is outputted to each of the fuel injectors 5 for fuel injection in the intake stroke of the corresponding cylinder during homogeneous combustion and in the compression stroke of the corresponding cylinder during stratified combustion.

Figure 14:
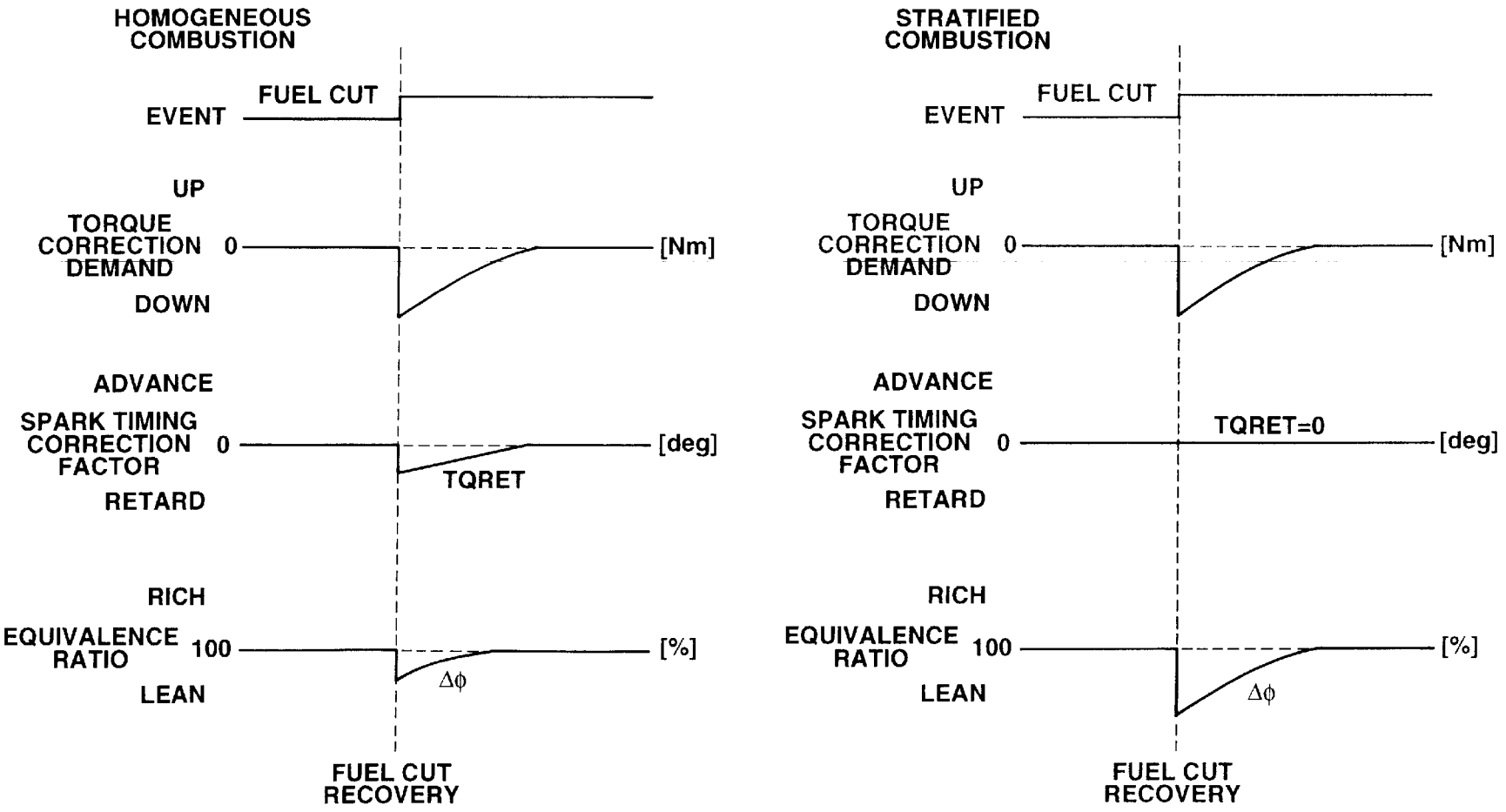
FIG. 14 shows response waveforms for the third embodiment.

FIG. 14 shows response waveforms for the third embodiment. Assuming that a demand for torque correction (torque down demand) is produced in the presence of a fuel cut, the spark timing and equivalence ratio (air-fuel ratio) are corrected to correct the torque during homogeneous combustion, whereas the equivalence ratio (air-fuel ratio) is corrected to a greater extent, without correcting the spark timing, to correct the torque during stratified combustion.

Fourth Embodiment

Figure 10:
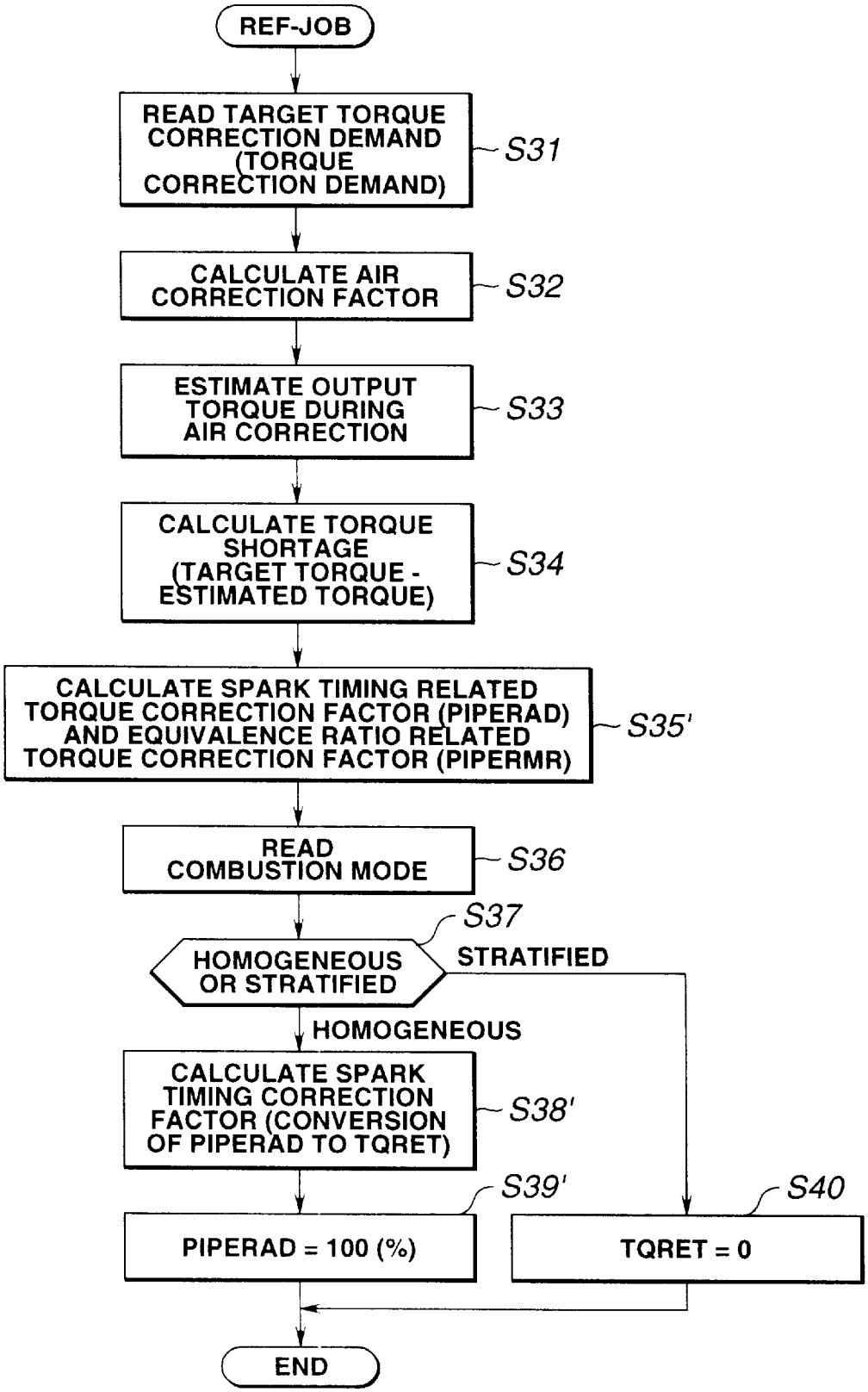
FIG. 10 is a flow diagram showing a torque correction factor calculating routine used in a fourth embodiment.

In the fourth embodiment, the torque correction is made as shown in FIG. 10, the spark timing calculation is made as described above in connection with FIG. 4, and the fuel delivery requirement calculation is made as described above in connection with FIG. 9.

FIG. 10 shows a torque correcting routine executed in synchronism with the reference pulse signal REF (REF-JOB). FIG. 10 is different from FIG. 6 in steps S35', S38' and S39'.

In step S31, a torque correction demand (increase or decrease demand) resulting from the target torque for torque demand control, a gear shift, the air conditioner being turned on, fuel cut recovery, or the like is read.

In step S32, an air correction factor for the target torque or the torque correction demand is calculated to control the degree of opening of the electronic controlled throttle valve 4.

In step S33, the output torque during air correction is estimated.

In step S34, the estimated torque is subtracted from the target torque (based on the torque demand control target torque or the torque correction demand) to calculate a torque shortage.

In step S35', a torque correction factor is calculated in accordance with the torque shortage. The torque correction factor is divided into a spark timing related torque correction factor PIPERAD and an air-fuel ratio related torque correction factor PIPERMR. The spark timing related torque correction factor and the air-fuel ratio related torque correction factor are calculated based on the torque shortage from step S34 in the following manner:

under stratified combustion:

$$PIPERAD : PIPERMR = 0 : 100$$

under homogeneous combustion:

$$PIPERAD : PIPERMR = x : (100 - x)$$

a value retrieved from a map based on the driving condition (engine speed, torque). In this case, 100% indicates no correction, more than 100% indicates a torque increase demand and less than 100% indicates a torque decrease demand.

In step S36, the combustion mode is read.

In step S37, a determination is made as to whether the combustion mode is homogeneous combustion (homogeneous stoichiometric combustion or homogeneous lean combustion) or stratified combustion (stratified lean combustion).

If the combustion mode is homogeneous combustion, then the program proceeds to step S38' wherein the spark timing related torque correction factor PIPERAD is converted to a spark timing correction factor TQRET. In step S39', the spark timing related torque correction factor PIPERAD is returned to 100% and this program is ended.

If the combustion mode is stratified combustion, then the program proceeds to step S40 wherein the spark timing correction factor TQRET is set at 0 and this program is ended. In this case, the spark timing related torque correction factor PIPERAD is held at the value calculated in step S35'.

Thereafter, control is made according to the spark timing calculation routine of FIG. 4 and the fuel delivery requirement calculation routine of FIG. 9.

Figure 15:
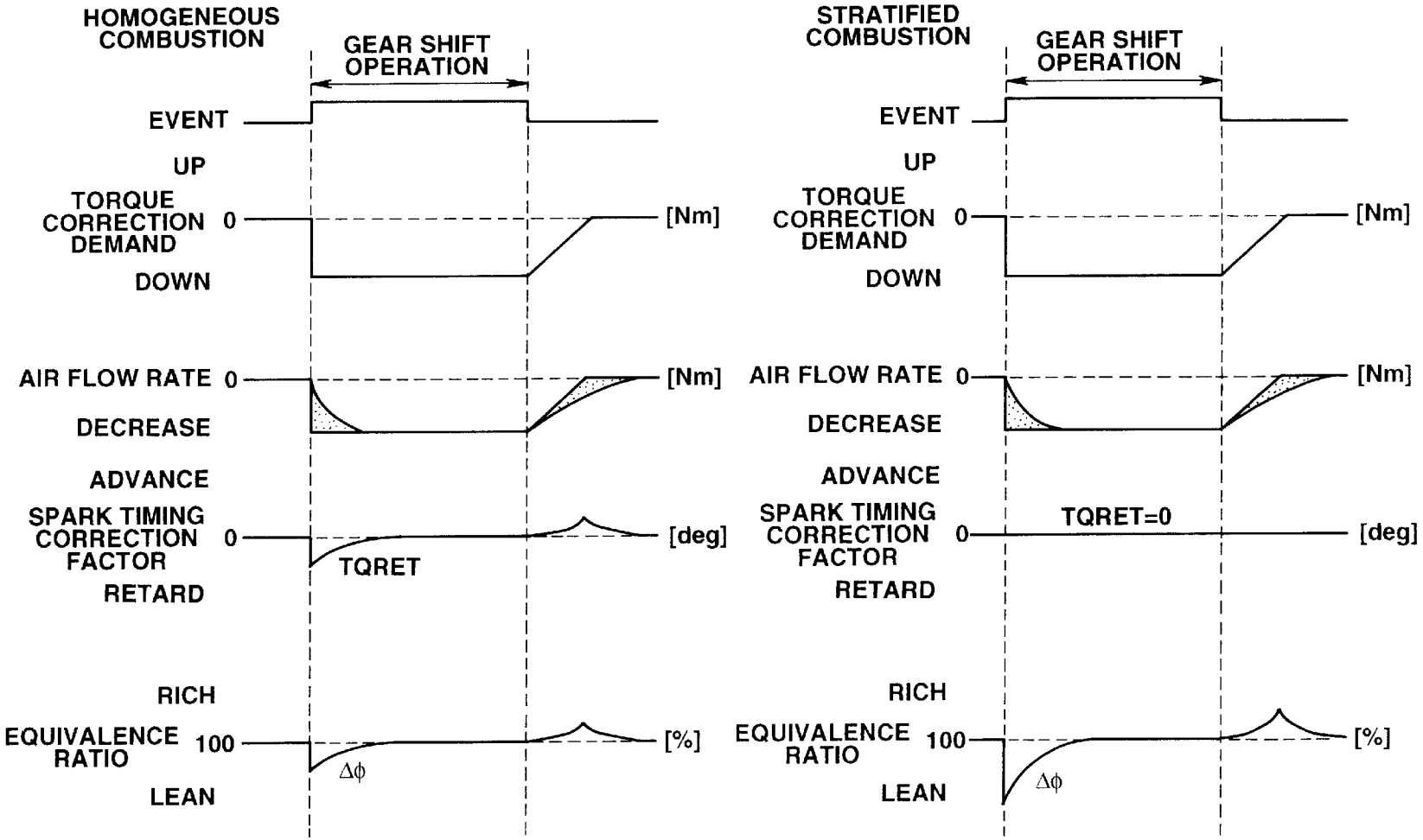
FIG. 15 shows response waveforms for the fourth embodiment.

FIG. 15 shows response waveforms for the fourth embodiment. Assuming that a demand for torque correction (torque down demand) is produced in the presence of a gear shift, the amount of air to the engine is decreased; however, too much torque occurs because of the delay in air flow rate control. In order to correct the torque excess, the spark timing and equivalence ratio (air-fuel ratio) are corrected to correct the torque during homogeneous combustion. The equivalence ratio (air-fuel ratio) is corrected to a greater extent, without correcting the spark timing, to correct the torque during stratified combustion.

Fifth Embodiment

Figure 11:
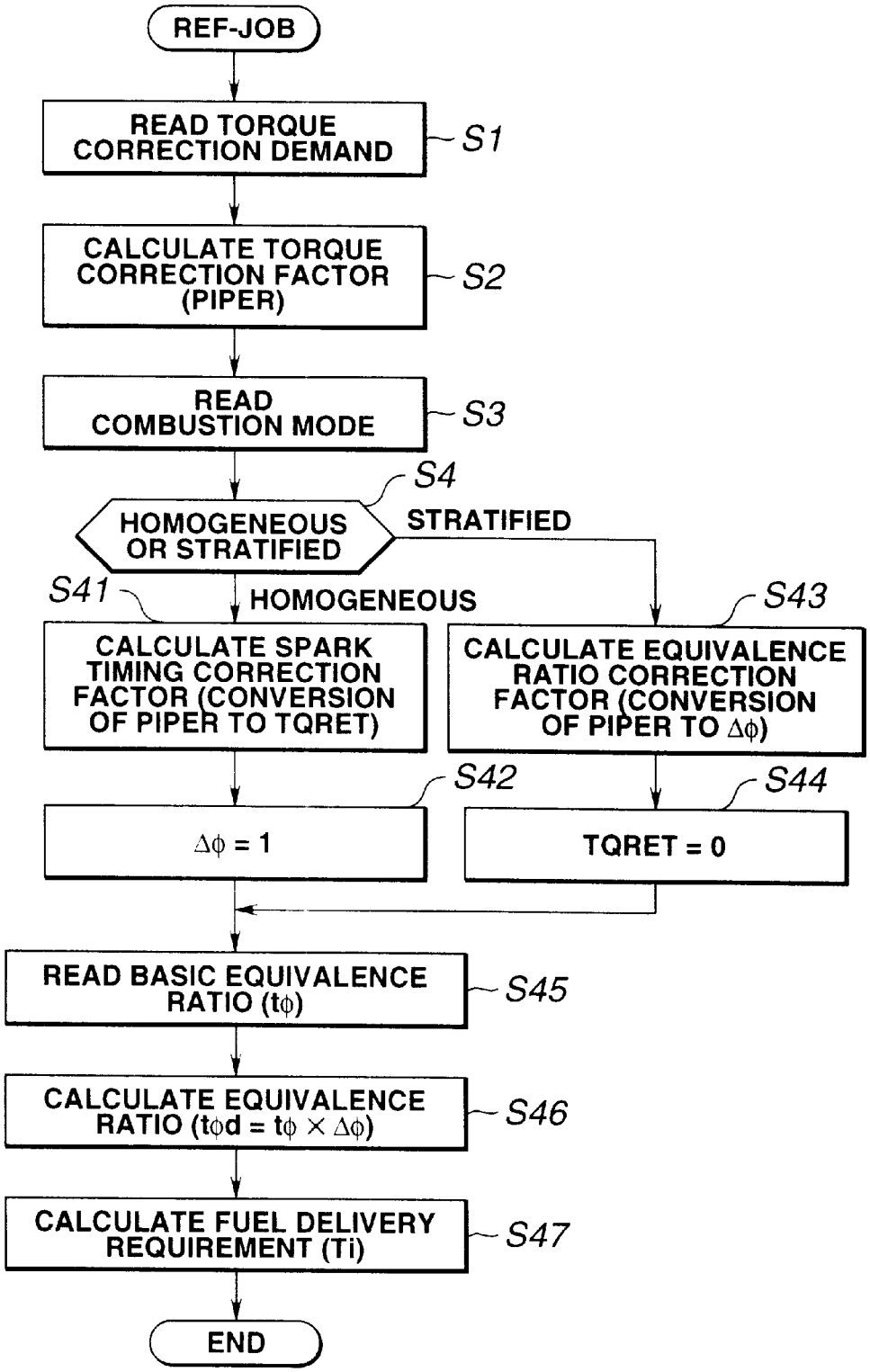
FIG. 11 is a flow diagram showing a torque correction factor and fuel delivery calculating routine used in a fifth embodiment.

In the fifth embodiment, calculations for the torque correction factor and fuel delivery requirement are made as shown in FIG. 11, and the spark timing calculation is made as described above in connection with FIG. 4.

In step S1, the torque correction demand (demand for increase or decrease) which can result from a gear shift operation, air conditioner turning on operation, or fuel cut recovery, or the like, is read.

In step S2, a torque correction factor PIPER ($100\pm\alpha\%$) is calculated in accordance with the torque correction demand. In this case, no correction is made when PIPER=100%, a torque increasing demand correction is made when PIPER>100%, and a torque decreasing demand correction is made when PIPER<100%.

In step S3, the combustion mode is read.

In step S4, a determination is made as to whether the combustion mode is homogeneous combustion (homogeneous stoichiometric combustion or homogeneous lean combustion) or stratified combustion (stratified lean combustion).

If the combustion mode is homogeneous combustion, then the program proceeds to step S41 wherein the torque correction factor PIPER is converted to the spark timing correction factor TQRET. In step S42, the equivalence ratio correction factor $\Delta\phi$ is set to 1. Following this, the program proceeds to steps S45 to S47.

If the combustion mode is stratified combustion, then the program proceeds to step S43 wherein the torque correction factor PIPER is converted to a n equivalence ratio correction factor $\Delta\phi$, and then to step S44 wherein the spark timing correction factor TQRET is set to 0. Following this, the program proceeds to steps S45 to S47.

In step S45, the basic equivalence ratio $t\phi$ (set in another routine) is read for air-fuel ratio control.

In step S46, the target equivalence ratio $t\phi d$ is calculated by multiplying the basic equivalence ratio by the equivalence ratio correction factor $\Delta\phi$ as follows:

$$t\phi d = t\phi \times \Delta\phi$$

In step S47, the basic fuel delivery requirement Tp is corrected for the target equivalence ratio $t\phi d$ and the like to calculate the eventual fuel delivery requirement Ti according to the following equation $$Ti = Tp \times t\phi d \times K\alpha + Ts$$

The fuel delivery requirement Ti calculated in such a manner is set in a predetermined register. An injection pulse signal having a pulse width corresponding to Ti is outputted to each of the fuel injectors 5 to inject fuel in the intake stroke of the corresponding cylinder during homogeneous combustion and in the compression stroke of the corresponding cylinder during stratified combustion.

Control of spark timing is made according to the spark timing calculation routine of FIG. 4.

In the fifth embodiment, the fuel delivery requirement calculation is made in synchronism with engine rotation (REF-JOB) like the torque correction factor calculation.

Differences between fuel delivery requirement calculation made in synchronism with time (10 ms-JOB) as described above in connection with the first to fourth embodiments and fuel delivery requirement calculation made in synchronism with engine rotation (REF-JOB) as described in connection with the fifth embodiment will now be described.

Assuming that calculations made in synchronism with rotation (REF-JOB) are for a four-cylinder engine, the period of the reference pulse signal REF produced for each 180° of crankshaft rotation will change with engine speed approximately as follows:

1000 rpm . . . 30 ms 3000 rpm . . . 10 ms 5000 rpm . . . 6 ms 6000 rpm . . . 5 ms Thus, the processing load required for the calculations is as great as compared to the ms-JOB at 3000 rpm or more and double the 10 ms-JOB at 6000 rpm. This tendency increases for 6 and 8 cylinder engines.

For this reason, the processing load required for the calculations is decreased, in the first to fourth embodiments, by executing the fuel delivery requirement calculation in synchronism with time (10 ms-JOB). The reason why the response speed during stratified combustion is not degraded by making the calculations in synchronism with time is as follows.

At low loads (1200 rpm or less) during stratified combustion, 10 ms-JOB is executed between the time at which the torque correction factor is calculated (in synchronism with rotation) and the time at which fuel is injected. Thus, it is possible to realize the same response characteristic as realized with spark timing adjustment during homogeneous combustion.

The reflection of the torque correction factor on the fuel delivery requirement is made in synchronism with time (10 ms-JOB) even at greater engine speeds, and the control is made at uniform intervals of 10 ms. However, sufficient control can be made for torque correction demands on such a time scale.

Figure 16:
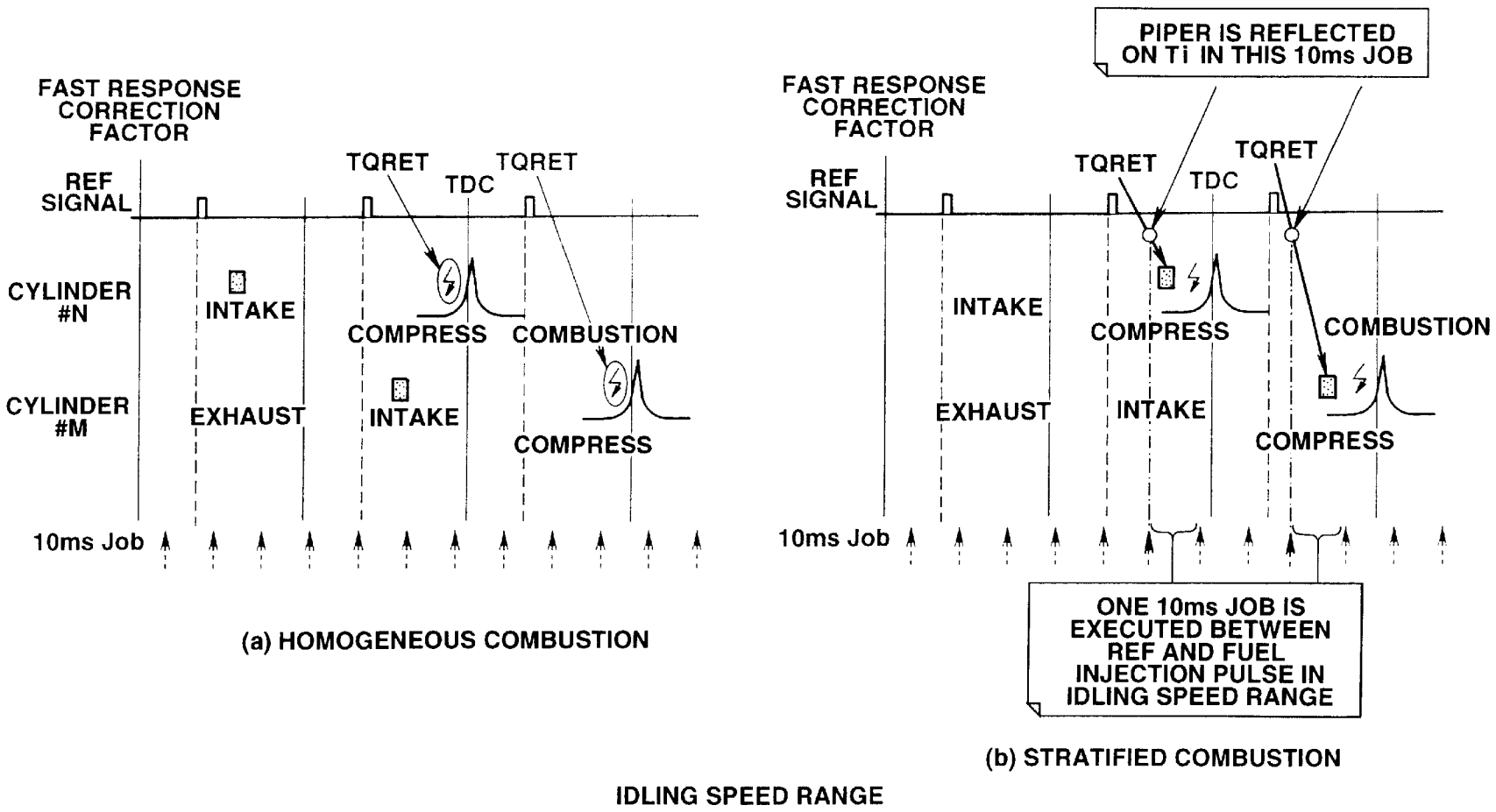
FIG. 16 shows time synchronous calculation of the fuel delivery requirement during idling.
Figure 17:
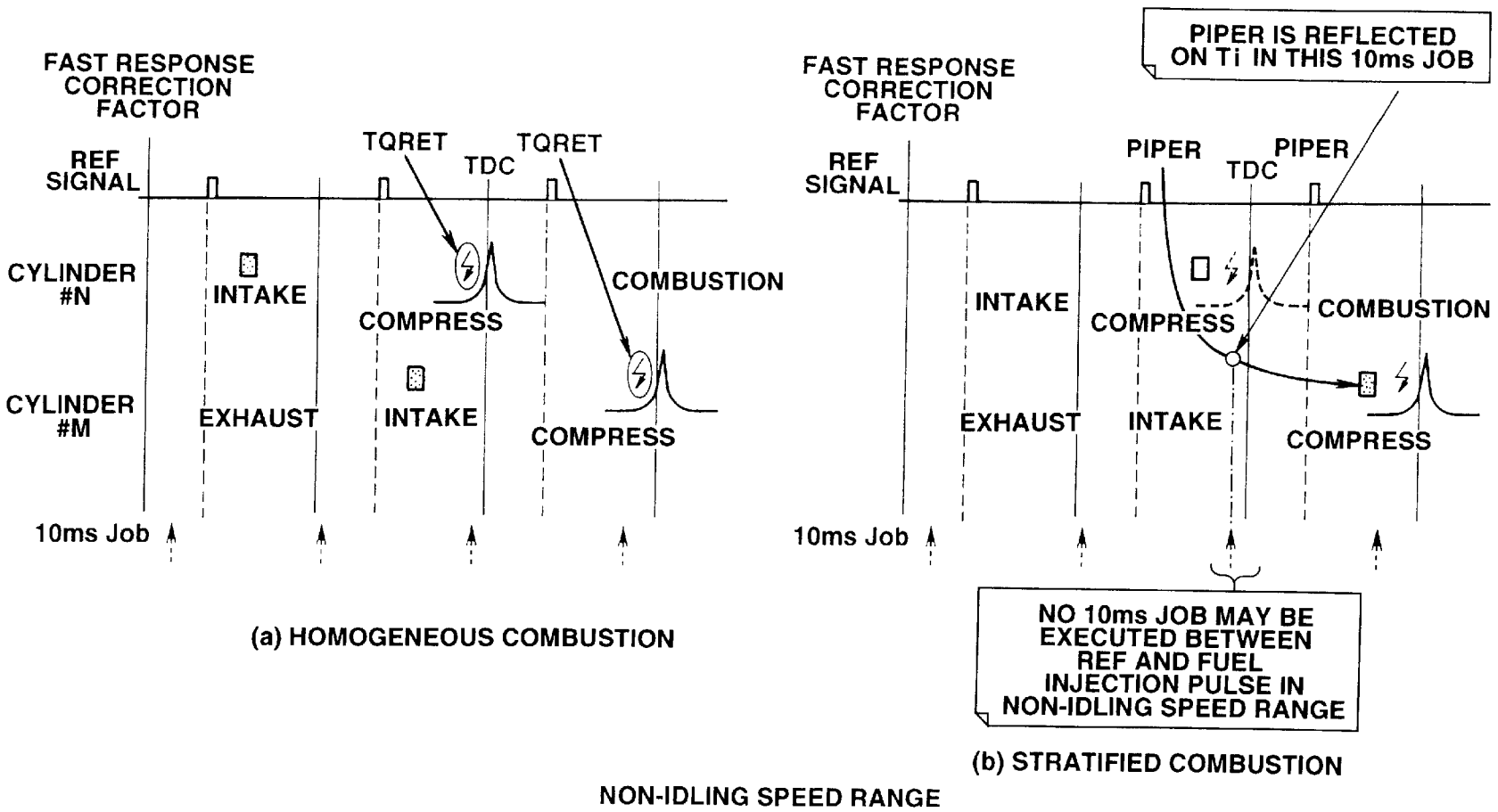
FIG. 17 shows time synchronous calculation of the fuel delivery requirement above idling speed.
Figure 18:
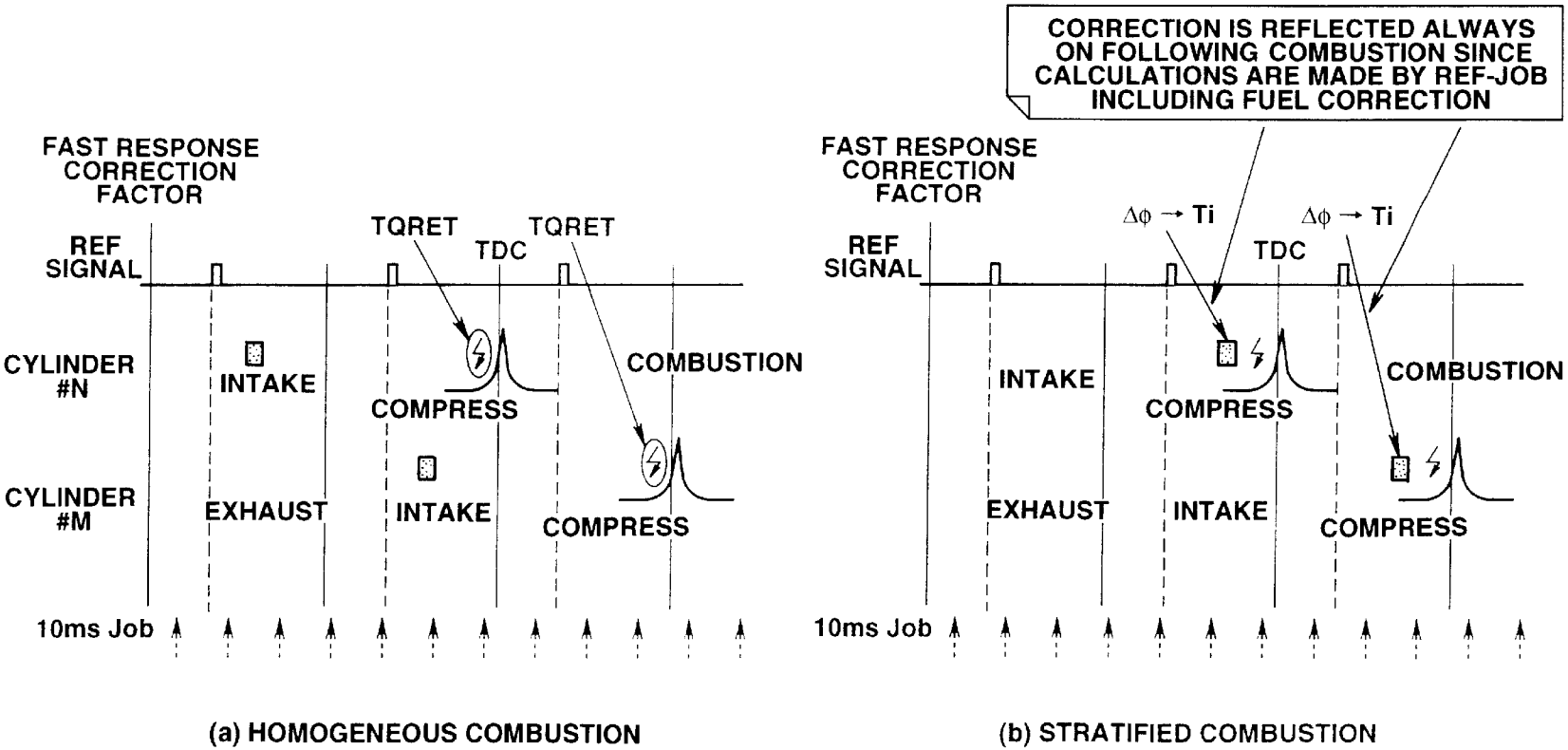
FIG. 18 shows rotation synchronous calculation of the fuel delivery requirement (fifth embodiment).

FIGS. 16 to 18 show the timing chart of the operation as to two cylinders of the engine. A Z-shape arrow represents a spark timing, a shaded rectangle shows a fuel delivery, and a triangular wave shows a pressure in the cylinder raised by the combustion.

Referring to FIG. 16, the influence on performance is dependent on whether the reflection of the correction factor is delayed one combustion at low engine speeds, for example, at idling speeds. Since the correction factor (TQRET) is calculated by REF-JOB during homogeneous combustion and reflected immediately on spark timing set by the REF signal during homogeneous combustion (when the correction factors (TQRET, PIPER) are calculated by REF-JOB and the reflection on the fuel delivery requirement is made by 10 ms-JOB), it is possible to reflect the correction factor on the combustion just after the REF signal. Homogeneous combustion might be used while idling if, for example, accessory loads are high and the engine is cold. Although the correction factor (PIPER) is calculated by REF-JOB during stratified combustion, at least one 10 ms-JOB is executed between the time at which a REF signal is produced and the time at which a fuel injection pulse is produced at low engine speeds. Thus, the correction factor can be reflected on the combustion just after the REF signal, like operation with homogeneous combustion.

It is, therefore, possible to make torque corrections with the same response characteristics for both stratified combustion and homogeneous combustion in the low engine speed range, such as the idling speed range.

As shown in FIG. 17, at engine speeds above idling speeds, if the correction factors (TQRET, PIPER) are calculated by REF-JOB and the reflection on the fuel delivery requirement is made by 10 ms-JOB, the correction factor (TQRET) is calculated by REF-JOB and reflected immediately on the spark timing set by the REF signal during homogeneous combustion so that the correction factor is reflected on the combustion just after the REF signal.

Although the correction factor (PIPER) is calculated by REF-JOB during stratified combustion, no 10 ms-JOB routine can be executed between the time at which the REF signal is produced and the time at which a fuel injection pulse is produced, in this engine speed range. In this case, the calculated correction factor is reflected on the next combustion.

Thus, the time at which the correction factor is reflected may be delayed during stratified combustion as compared to homogeneous combustion. However, this manner of calculation can reduce the processing load required for the calculations of REF-JOB and can prevent an increase in the processing load required for calculations made in synchronism with rotation when the engine speed is increasing.

Since it is sufficient for a greater part of the correction demand values to be handled in synchronism with time, and the reflection timing is not severe at engine speeds except for idling speeds, there is no performance reduction problem if the corrected fuel delivery values are reflected at time intervals of 10 ms.

It is, therefore, possible to correct the torque with sufficient response regardless of whether homogeneous or stratified combustion is occurring, while also preventing an increase in the processing load required for calculations made in synchronism with rotation at engine speeds above idling speeds.

FIG. 18 illustrates the effect of the fifth embodiment. Both the correction factor TQRET and the fuel delivery requirement Ti can be calculated by REF-JOB when the control unit has a sufficiently great processing ability. The correction of the amount of fuel to the engine during stratified combustion is reflected on the combustion just after the REF signal, like the correction to spark timing made during homogeneous combustion.

It is thus possible to realize torque correction with a sufficient response regardless of whether the combustion mode is homogeneous combustion or stratified combustion, over the entire engine speed range.

Figure 19:
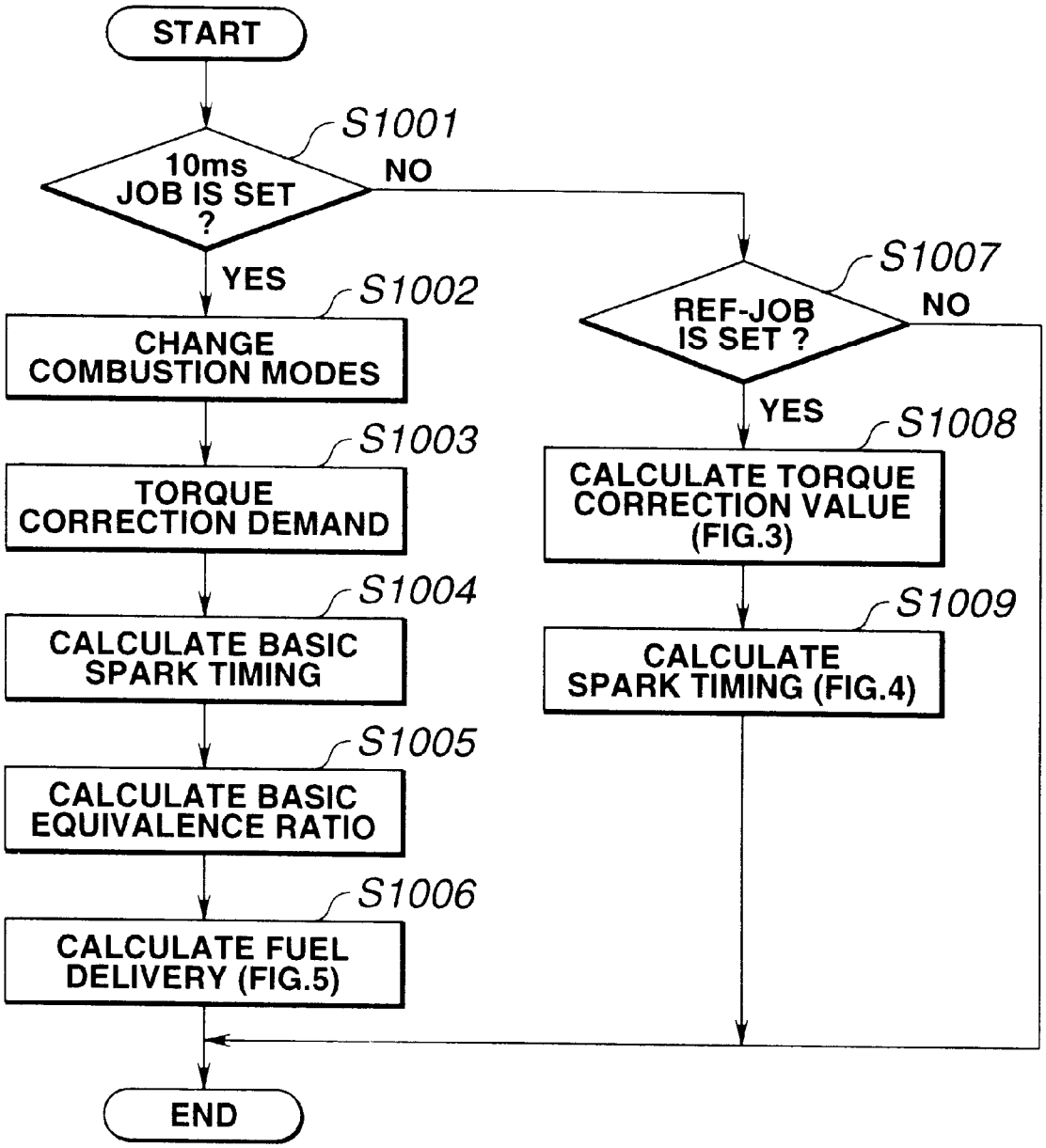
FIG. 19 illustrates one arrangement of overall processing.

FIG. 19 illustrates one arrangement for overall processing. This processing includes the torque correction calculations of FIG. 3, the spark timing calculations of FIG. 4, and the fuel delivery calculations of FIG. 5. This processing also includes torque correction demand processing, change of combustion mode processing, basic spark timing calculation processing and processing for calculating basic equivalence ratio tϕ.

In step S1001, a determination is made as to whether a 10 ms job is set. A counter in the control unit 20 outputs a clock signal every 10 ms. If the clock signal was output between the last process and the current process, a "YES" determination is made and the processing proceeds on to step S1002. The general flow of FIG. 19 itself is processed under a 1 or 2 ms job.

In step S1002, the combustion mode is changed. For example, stratified charge combustion or homogenous charge combustion can be selected. Selection of the combustion mode based on various conditions is described, for example, in a U.S. Patent Application entitled "Direct Injection Gasoline Engine with Stratified Charge Combustion and Homogeneous Charge Combustion" filed under Attorney Docket Number 040679/0625. In step S1003, torque correction demand processing is performed and in step S1004 basic spark timing is calculated.

In step S1005, the basic equivalence ratio is calculated, as discussed above. In step S1006, fuel delivery is calculated as discussed above in connection with FIG. 5.

In step S1007, a determination is made as to whether REF-JOB is set. If the REF signal is output between the last process and the current process, "YES" is obtained and the processing proceeds to step S1008. In step S1008, a torque correction value is calculated, as discussed above in connection with FIG. 3. In step S1009, spark timing is calculated, as discussed above in connection with FIG. 4.

Figure 20:
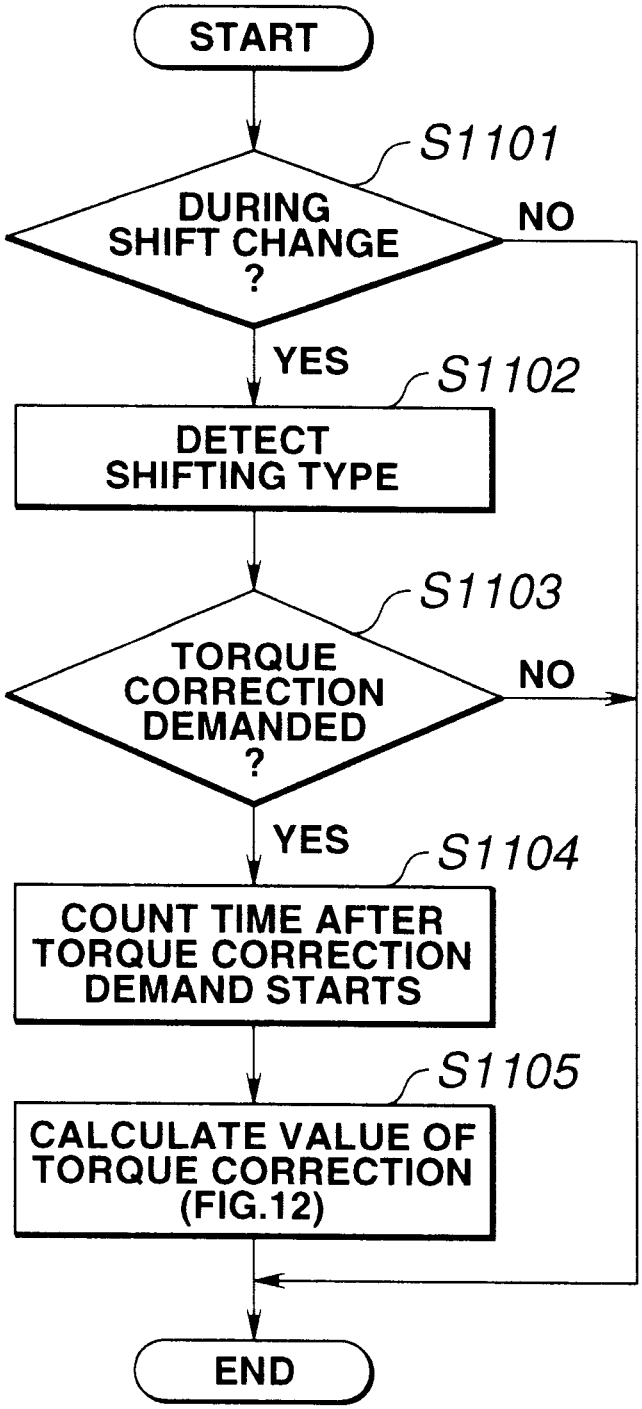
FIGS. 20 to 22 illustrate torque correction demand processing under various conditions.
Figure 21:
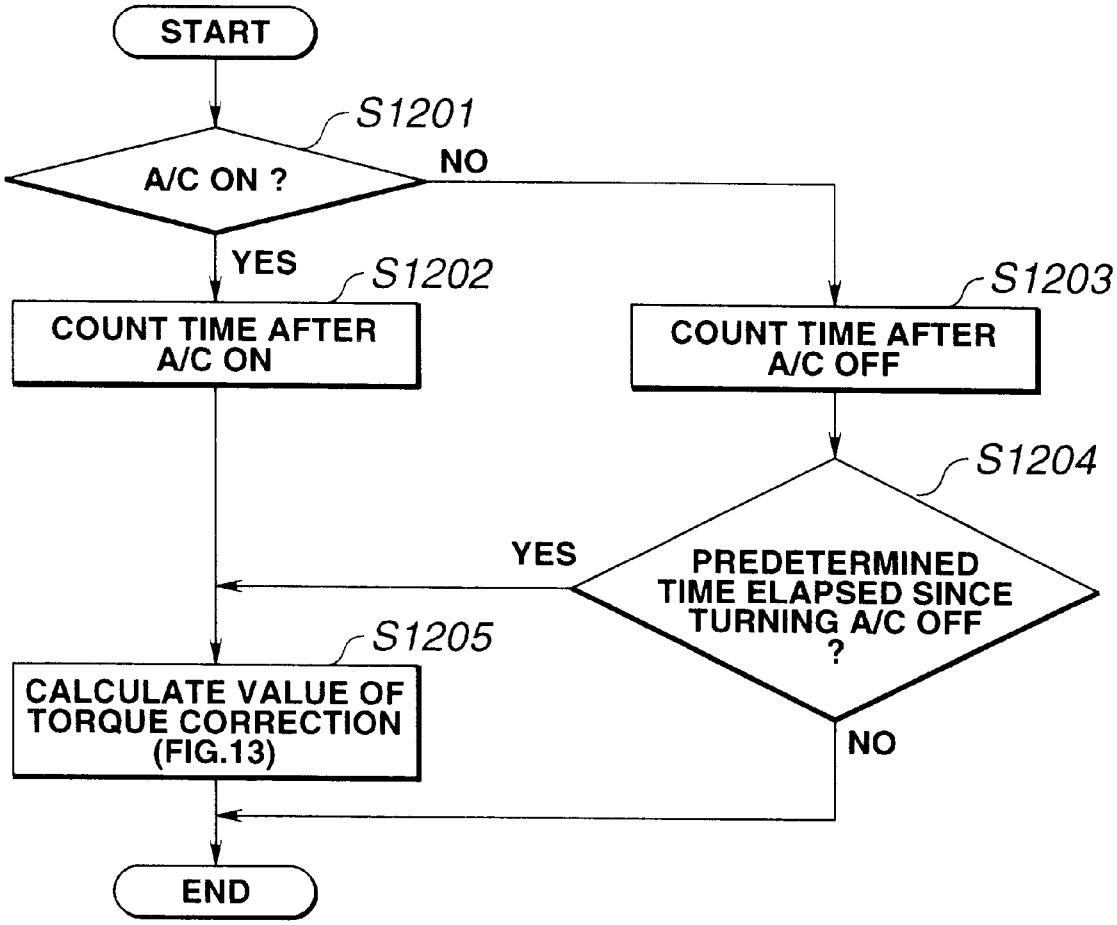
Figure 22:
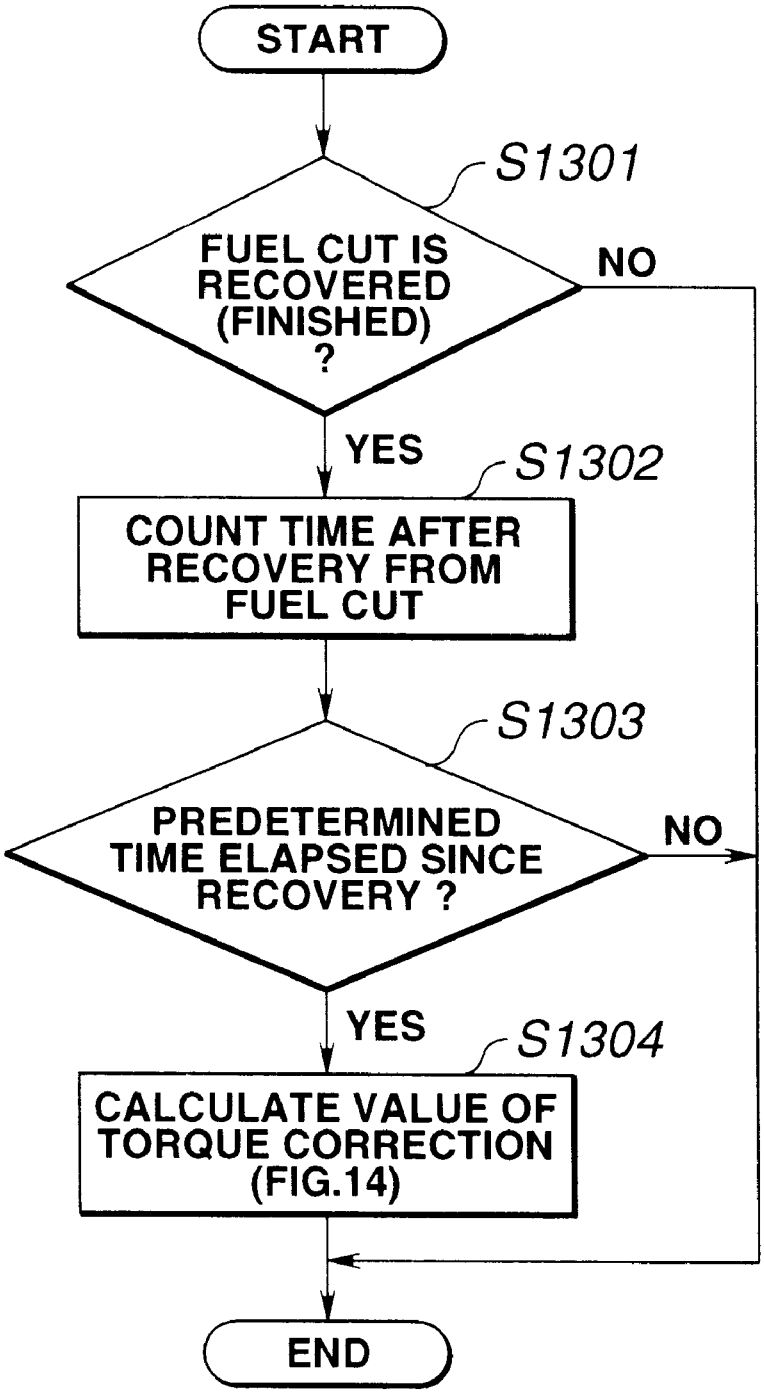

FIGS. 20–22 show torque correction demand processing under various conditions. FIG. 20 shows the processing for a shift change. FIG. 21 shows the processing for the air conditioner compressor being turned on/off. FIG. 22 shows the processing for fuel cut recovery.

In FIG. 22, a determination is made in step S1101 as to whether a shift change is occurring. If yes, the processing proceeds to step S1102. Otherwise, the processing proceeds to the end. In step S1102, the shifting type is detected. In step S1103, a determination is made as to whether torque correction is demanded. If yes, the processing proceeds to step S1104. Otherwise, the processing proceeds to the end.

In step S1104, the time after the torque correction demand starts is counted. In step S1105, the value of torque correction is calculated and torque is corrected as shown in FIG. 12.

In FIG. 21, step S1201, a determination is made as to whether the air conditioner is on. If the air conditioner is on, the processing proceeds to step S1202. Otherwise, the processing proceeds to step S1203. In step S1202, the time after the air conditioner has been turned on is counted. In step S1203, the time after the air conditioner has been turned off is counted. After step S1203, the processing proceeds to step S1204. In step S1204, a determination is made as to whether a predetermined time has elapsed since turning the air conditioner off. If yes, the processing proceeds to step S1205. Otherwise, the processing proceeds to the end. In step S1205, the value of the torque correction is calculated and torque is corrected as shown in FIG. 13.

In FIG. 22, step S1301 makes a determination as to whether a fuel cut is recovered (finished). If no, the processing proceeds to the end. Otherwise, the processing proceeds to step S1302. In step S1302, the time after the recovery from the fuel cut is counted. In step S1303, a determination is made as to whether a predetermined time has elapsed since recovery. If no, the processing proceeds to the end. Otherwise, the processing proceeds to step S1304. In step S1304, the value of torque correction is calculated and torque is corrected as shown in FIG. 14.

Figure 23:
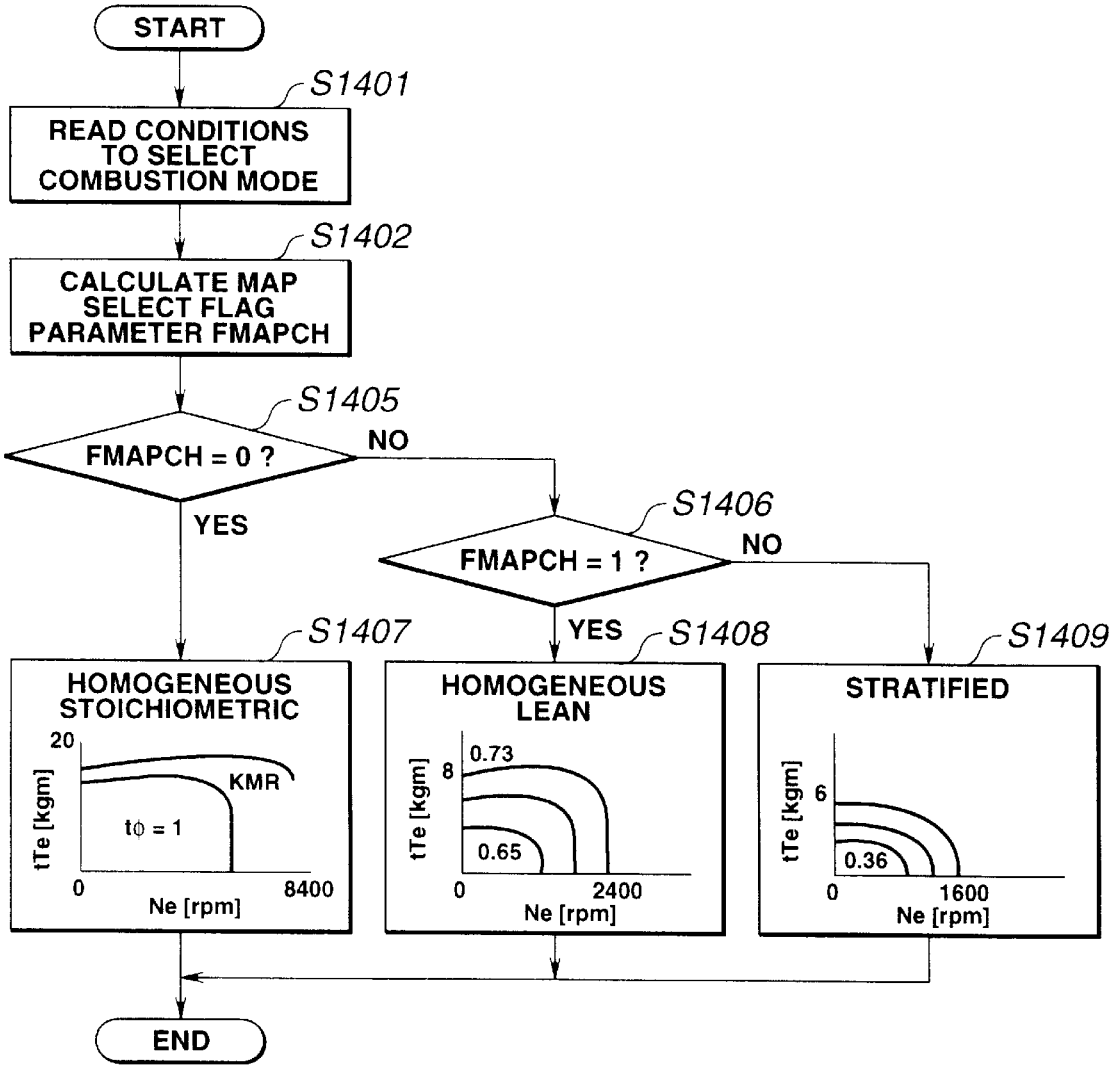
FIG. 23 illustrates processing to select a combustion mode and basic equivalence ratio.

FIG. 23 is a flowchart which shows an example of processing to select the combustion mode and basic equivalence ratio tϕ. As discussed above, this processing is employed in connection with step S3 of FIG. 3, and step S21 of FIG. 5.

In step S1401, the conditions to select a combustion mode are read. These conditions can include, for example, water temperature, the time from engine starting, driving conditions such as engine revolution speed Ne and target torque, and the like.

In step S1402, a map select flag parameter FMAPCH is calculated in accordance with a combustion mode selected. Steps S1405 and 1406 select the appropriate map based on the combustion mode, according to FMAPCH. The processing proceeds to step S1407 for the homogeneous stoichiometric combustion condition. The processing proceeds to step S1408 for the homogeneous lean condition. The processing proceeds to step S1409 for the stratified combustion condition. In each of steps S1407 to S1409, the basic equivalence ratio tϕ is selected from a map based on engine speed Ne and target torque (tTe=tTeO).

The entire contents of Japanese patent application No. 9-168419 (filed Jun. 25, 1997) and Press Information entitled "Nissan Direct-Injection Engine" (Document E1-2200-9709 of Nissan Motor Co., Ltd., Tokyo, Japan) are incorporated herein by reference.

Although the invention has been described above by reference to certain embodiments of the invention, the invention is not limited to the embodiments described above. Modifications and variations of the embodiments described above will occur to those skilled in the art, in light of the above teachings. For example, the characteristic curves shown in the Figures are merely examples and other curves and techniques can be employed. The scope of the invention is defined with reference to the following claims.

What is claimed is:

1. A controller for an engine which operates in a homogeneous combustion mode and a stratified combustion mode, the controller comprising:

a detector to detect whether the engine is operating in a homogeneous combustion mode or a stratified combustion mode; and a torque correction section, coupled to the detector, which receives a torque correction demand and produces a torque correction output in response to the torque correction demand, the torque correction output varying spark timing when the detector detects that the engine is in the homogeneous combustion mode and varying a ratio of air and fuel when the detector detects that the engine is in the stratified combustion mode.

2. A controller as set forth in claim 1, wherein the torque correction output varies a ratio of air and fuel but not spark timing when the detector detects that the engine is in the stratified combustion mode.

3. A controller as set forth in claim 1, wherein the torque correction output varies spark timing and a ratio of air and fuel when the detector detects that the engine is in the homogeneous combustion mode.

4. A controller as set forth in claim 1, wherein the torque correction section calculates an intake air flow amount to satisfy the torque correction demand and produces an air flow amount output corresponding thereto, and wherein the torque correction section varies spark timing when the detector detects that the engine is in a homogeneous combustion mode to compensate for a delay in actual air flow reaching air flow specified by the air flow amount output, and varies the ratio of air and fuel when the detector detects that the engine is in a stratified combustion mode to compensate for a delay in actual air flow reaching air flow specified by the air flow amount output.

5. A controller as set forth in claim 4, wherein the torque correction section varies spark timing and a ratio of air and fuel when the detector detects that the engine is in a homogeneous combustion mode to compensate for the delay in actual air flow reaching air flow specified by the air flow amount output.

6. A controller as set forth in claim 1, further comprising a fuel delivery calculation section, wherein the fuel delivery calculation section performs fuel delivery calculations in a loop having a constant repetition time, and wherein the torque correction section performs its calculations in a loop whose repetition time varies with engine speed.

7. A controller as set forth in claim 1, wherein the torque correction section calculates an intake air flow amount to satisfy the torque correction demand and produces an air flow amount output corresponding thereto, and wherein the torque correction section varies spark timing when the detector detects that the engine is in a homogeneous combustion mode to compensate for a delay in actual air flow reaching air flow specified by the air flow amount output.

8. A controller as set forth in claim 2, wherein the torque correction output varies spark timing and a ratio of air and fuel when the detector detects that the engine is in the homogeneous combustion mode.

9. A controller as set forth in claim 4, wherein the torque correction section varies a ratio of air and fuel but not spark timing when the detector detects that the engine is in the stratified combustion mode.

10. A controller as set forth in claim 1, further comprising a fuel delivery calculation section performing fuel delivery calculations, and wherein the fuel delivery calculation section and the torque correction section perform the calculations in loops, each having repetition time varying with engine speed, respectively.

* * * * *